US007708268B2

(12) United States Patent
Toya et al.

(10) Patent No.: US 7,708,268 B2
(45) Date of Patent: May 4, 2010

(54) SEPARATOR AND FEEDER WITH VIBRATOR FOR SHEETS OF PAPER MEDIUM

(75) Inventors: Kiminori Toya, Kawasaki (JP); Hideki Nukada, Yokohama (JP); Yuko Kobayashi, Kawasaki (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 414 days.

(21) Appl. No.: 11/805,167

(22) Filed: May 22, 2007

(65) Prior Publication Data

US 2007/0273080 A1 Nov. 29, 2007

(30) Foreign Application Priority Data

May 23, 2006 (JP) ..... 2006-143113

(51) Int. Cl.
*B65H 3/60* (2006.01)

(52) U.S. Cl. ..... 271/146

(58) Field of Classification Search ..... 271/146, 271/145, 111

See application file for complete search history.

(56) References Cited

U.S. PATENT DOCUMENTS

| | | | | |
|---|---|---|---|---|
| 2007/0205551 | A1 * | 9/2007 | Nukada et al. | 271/90 |
| 2009/0218752 | A1 * | 9/2009 | Kobayashi et al. | 271/10.09 |

FOREIGN PATENT DOCUMENTS

| | | | |
|---|---|---|---|
| JP | 06048602 | | 2/1994 |
| JP | 06329287 | | 11/1994 |
| JP | 07109026 | | 4/1995 |
| JP | 2000-177869 | | 6/2000 |
| JP | 2000-219334 | | 8/2000 |
| JP | 2000219334 | A * | 8/2000 |
| JP | 2002-356240 | | 12/2002 |
| JP | 2003-261238 | | 9/2003 |
| JP | 2004-2044 | | 1/2004 |
| JP | 2004002044 | A * | 1/2004 |
| JP | 2004091057 | | 3/2004 |
| JP | 3766809 | | 2/2006 |

OTHER PUBLICATIONS

Japanese Search Report with Translation dated May 7, 2008 based on JP application No. 2006-143113.
U.S. Appl. No. 11/535,733, Sep. 27, 2006, Hideki Nukada.

* cited by examiner

*Primary Examiner*—Patrick H Mackey
*Assistant Examiner*—Gerald W McClain
(74) *Attorney, Agent, or Firm*—Ohlandt, Greeley, Ruggiero & Perle, L.L.P.

(57) ABSTRACT

A pile of sheets is held by a separator/feeder and a vibrator is brought into contact with a first region of the pile with a first contact pressure. High frequency vibrations are applied from the vibrator to the sheet. A takeout mechanism is brought into contact with and pressed against the pile with a second contact pressure and sheets are taken out one by one from the top surface of the pile by the takeout mechanism. A first sensor detects the position of the vibrator and outputs a first detection signal, while a second sensor detects the uppermost surface of the pile and outputs a second detection signal. A control section selects first and second contact pressures according to the first and second detection signals and maintains the first and second contact pressures.

28 Claims, 16 Drawing Sheets

SEPARATOR AND FEEDER WITH VIBRATOR FOR SHEETS OF PAPER MEDIUM

CROSS-REFERENCE TO RELATED APPLICATIONS

This application is based upon and claims the benefit of priority from prior Japanese Patent Application No. 2006-143113, filed May 23, 2006, the entire contents of which are incorporated herein by reference.

BACKGROUND OF THE INVENTION

1. Field of the Invention

This invention relates to a separator/feeder for sheets of paper or paper-like medium for taking out such a medium. More particularly, the present invention relates to a separator/feeder for sheets of paper or paper-like medium that separates and feeds sheets of such a medium one by one from a pile of sheets of the medium.

2. Description of the Related Art

An apparatus adapted to check and process sheets of paper or paper-like medium (to be simply referred to as paper-like medium hereinafter) such as a printer, a copying machine, an automatic teller machine, a banknote processing machine, a mail matter processing machine or the like handles sheets of paper-like medium such as sheets of printing paper, banknotes, sheets of copying paper, sealed letters, postcards, cards securities or the like, whichever appropriate. More specifically, such an apparatus is required to take out sheets one by one from a pile of a plurality of sheets of paper-like medium. Therefore, such a checking apparatus is equipped with a separator/feeder for separating and feeding sheets of paper-like medium one by one from a pile of sheets of paper-like medium. For example, a banknote processing section of an automatic teller machine repeats an operation of taking out a banknote from a pile of banknotes stored in an input/output section or a depository and examines it. Thus, an automatic teller machine is equipped with a separator/feeder for separating banknotes one by one from a pile of banknotes.

Conventionally, separators/feeders for separating and feeding sheets of paper-like medium from a pile of sheets of paper-like medium are required to accurately feed sheets one by one without duplication as the most important requirement that have to meet. Sheets of paper-like medium are apt to be adsorbed by each other in a pile because some of the sheets are inevitably frayed at the time of manufacturing, if slightly, and loosened fibers become entangled or the sheets are held in tight contact with each other or generate static electricity. To date, such sheets of paper-like medium are mostly separated by applying a strong force to the uppermost surface of the piled sheets and a predetermined number of sheets of paper-like medium are stripped off from the pile. Then, the sheets that are stripped off are separated from each other by a duplicate feeding prevention mechanism or the like and fed into the host apparatus one by one. Various techniques are selectively employed in such duplicate feeding prevention mechanisms and the sheets that are laid one on the other and taken out from the pile as a bunch are forced into a narrow gap and separated from each other by the most popular one of the known techniques. For example JP-A 2003-261238 (KOKAI) discloses a technique with which rollers are arranged at the opposite sides of a narrow gap to rotate in various different directions and sheets that are laid one on the other are forced to pass through the gap. Then, the sheets are subjected to forces in opposite directions and separated from each other. However, in many occasions, it is difficult to reliably and satisfactorily separate sheets into individual ones by means of such a mechanism. In other words, sheets of paper-like medium that are strongly adhering to each other can be caught by the gap and locked there to give rise to a trouble of bringing the apparatus to a halt.

Techniques of applying vibrations to the uppermost surface of a pile of sheets of paper-like medium to separate the sheets with ease have been discussed. For example, JP-A 2004-2044 (KOKAI) discloses a technique of applying vibrations to sheets of paper-like medium. With this technique, a beam-shaped vibrating part is applied to the entire surface of a pile of sheets of paper-like medium in the transversal direction at a position located immediately upstream relative to a feed mechanism to reduce the adhesion of the sheets so as to operate as an auxiliary means of a duplicate feeding prevention mechanism. For this purpose, a bar-shaped vibrating part having a length greater than the width of the sheets of paper-like medium is arranged upstream relative to a takeout roller and sheets of paper-like medium are fed while it is being vibrated.

However, the arrangement of applying vibrations to sheets of paper-like medium when taking out the sheets of paper-like medium as disclosed in JP-A 2004-2044 (KOKAI) is accompanied by a problem as described below. As a result of an experiment conducted by the inventors of the present invention, it is indispensably necessary to apply appropriate pressure between the vibrator and the sheets of paper-like medium in order to vibrate the piled sheets of paper-like medium and loosen them. In other words, the effect of separating sheets of paper-like medium is not obtained simply by controlling the height of the uppermost sheet as described in JP-A 2004-2044 (KOKAI).

A mechanism for separating sheets of paper-like medium by applying vibrations to the sheets of paper-like medium until they start vibrating as disclosed in JP-A 2002-356240 (KOKAI). However, the disclosed mechanism can be used only in an apparatus where a paper-like medium having certain predetermined characteristics is supplied and additionally it is not possible to separate sheets of paper-like medium by means of the mechanism unless pressure of an appropriate pressure level is applied to the vibrator. The mechanism disclosed in FIG. 3 of JP-A 2000-177869 (KOKAI) cannot separate sheets of paper-like medium for a similar reason.

Additionally, the paper-like medium feeding position of conventional paper-like medium processing machine is fixed and the machine is so devised that a take out mechanism such as a takeout roller operates to take out sheets of paper-like medium while applying appropriate pressure to the sheets. More specifically, JP-A 2000-219334 (KOKAI) discloses a mechanism comprising a movable lever that is held in contact with the top surface of piled sheets of paper-like medium to detect the position of the top surface and constantly keep the top surface of the piled sheets of paper-like medium to a same position. In short, it is possible for the prior art to take out sheet of paper-like medium reliably without depending on the type of paper-like medium only by means of such a mechanism.

However, the mechanism of using a vibrator held in contact with the surface of piled sheets of paper-like medium is accompanied by a problem that the pressure being applied by the vibrator resists the operation of taking sheets of paper-like medium one by one. Particularly, when sheets of paper-like medium is soft, the sheets of paper-like medium are pressed down by and engaged with the vibrator to adversely affect the operation of taking them out. Therefore, it may be necessary to regulate the pressure according to the state of being pressed down.

As pointed out above, mechanisms for preventing duplicate feeding that takes place when sheets of paper-like medium tightly adhere to each other by means of ultrasonic vibrations are accompanied by a problem that the technique of controlling the pressure applied to piled sheets of paper-like medium by means of a vibrator is not reliably established.

BRIEF SUMMARY OF THE INVENTION

According to an aspect of the present invention, there is provided a separator/feeder comprising:

a holding mechanism configured to hold a pile of sheets of paper-like medium;

a vibrator which is held in contact with a first region of the top surface of the pile under a first contact pressure to apply high frequency vibrations to sheets of paper-like medium;

a takeout mechanism configured to take out the sheets of paper-like medium one by one from top surface of the pile in a state of being held in contact with the top surface of the pile to apply a second contact pressure to the top surface of the pile;

a first sensor which detects a first position of the vibrator held in contact with the pile and output a first detection signal;

a second sensor which detects a second position of the top surface of the pile in a second region of the pile and outputs a second detection signal; and a control section configured to determine the first and second contact pressures according to the first and second detection signals and maintain the first and second contact pressures respectively in first and second predetermined ranges.

According a second aspect of the present invention, there is provided a separator/feeder comprising:

a holding mechanism configured to hold a pile of sheets of paper-like medium;

a vibrator which is held in contact with a first region of the top surface of the pile under a first contact pressure to apply high frequency vibrations to the sheets of paper-like medium;

a takeout mechanism configured to take out the sheets of paper-like medium one by one from top surface of the pile in a state of being held in contact with the top surface of the pile to apply a second contact pressure to the top surface of the pile;

a first sensor which detects the first position of the vibrator held in contact with the pile and outputs a first detection signal;

a second sensor which detects the second position of the top surface of the pile in a second region and outputs a second detection signal; and a control section configured to determine the first and second contact pressures according to the outcome of a comparison of a first displacement of the first position and a second displacement of the second position before and after taking out the sheet of paper-like medium from the top surface of the pile according to the first and second detection signals and maintain the first and second contact pressures respectively in first and second predetermined ranges.

According to a third aspect of the present invention, there is provided a separator/feeder comprising:

a holding mechanism configured to hold a pile of sheets of paper-like medium;

a vibrator which is held in contact with a first region of the top surface of the pile under a first contact pressure to apply high frequency vibrations to sheets of paper-like medium;

a takeout mechanism configured to take out the sheets of paper-like medium one by one from top surface of the pile in a state of being held in contact with the top surface of the pile to apply a second contact pressure to the top surface of the pile;

a first sensor which detects the first position of the vibrator held in contact with the pile and outputs a first detection signal;

a second sensor which detects the second position of the top surface of the pile in a second region of the pile and outputs a second detection signal; and a control section configured to compare the first and second detection signals to estimate the undulations of the first region of the pile, determine the first and second contact pressures according to the undulations and maintaining the first and second contact pressures respectively in first and second predetermined ranges.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

Now, embodiments of separator/feeder for sheets of paper-like medium according to the invention will be described with referring to the accompanying drawings.

Figure 1:
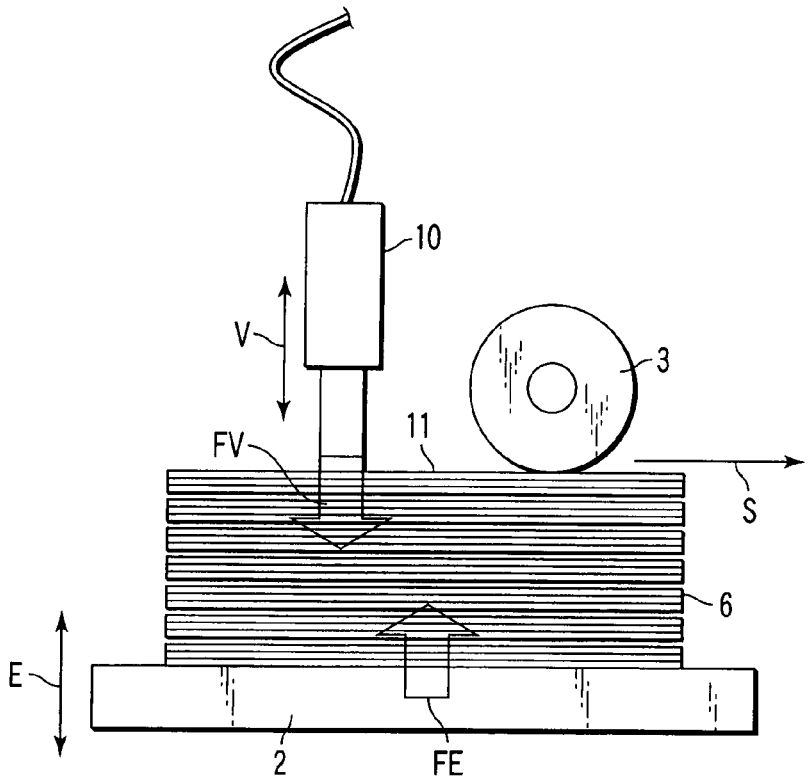
FIG. 1 is a schematic illustration of a separator/feeder for sheets of paper-like medium subjected to an experiment of observing the effect of loosening sheets of paper-like medium by means of vibrations.
Figure 2:
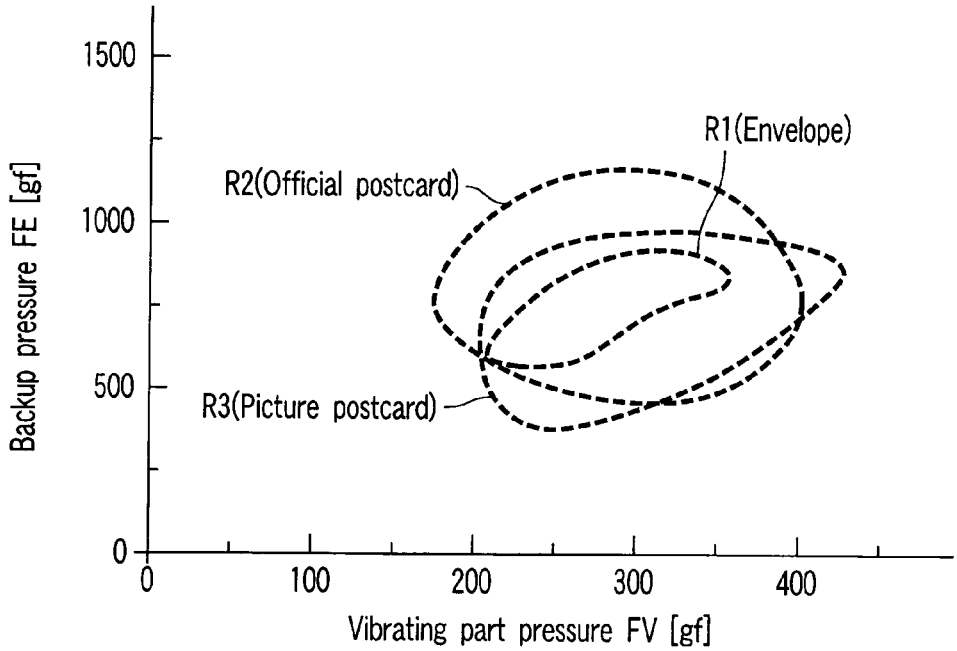
FIG. 2 is a graph summarily illustrating the results of the experiment conducted by using the separator/feeder for sheets of paper-like medium illustrated in FIG. 1.

Before describing the embodiment of separator/feeder for sheets of paper-like medium, the observations of the inventors of the present invention on a separator/feeder for sheets of paper-like medium will be firstly described by referring to FIGS. 1 and 2.

The inventors of the present invention conducted an experiment of observing the effect of loosening sheets of paper-like medium by means of vibrations in a separator/feeder for sheets of paper-like medium as illustrated in FIG. 1 and obtained results as summarily illustrated in FIG. 2.

The separator/feeder illustrated in FIG. 1 and driven to operate in the experiment comprises a backup table 2 for delivering sheets. Sheets 11 of paper-like medium are laid one on the other to form a pile 6 of sheets of paper-like medium on the backup table (sheet delivery table) 2. A vibrator 10 is arranged on and held in contact with the pile 6 to apply vibrations to the pile of sheets 11 of paper-like medium that are apt to adhere to each other. A takeout roller 3 for delivering sheets 11 of paper-like medium is also arranged on the pile 6. In other words, the sheets 11 of paper-like medium are fed onto the backup table 2 from below so as to be piled on the backup table 2 and then the backup table 2 is raised until the top surface of the pile 6 comes into contact with the takeout roller 3. As the takeout roller 3 is driven to rotate while it is held in contact with the pile 6, the uppermost sheet is taken out in the direction of arrow S in FIG. 1 and put into a sheet processing apparatus (not shown) due to the frictional force generated between the takeout roller 3 and the uppermost sheet 11 of paper-like medium of the pile 6. The vibrator 10 is driven to vibrate in the directions indicated by arrow V in FIG. 1 while backup force FE is applied to the pile 6 as the backup table 2 is raised in the direction indicated by arrow E in FIG. 1. Thus, the pile 6 is pressed against the takeout roller 3 and, at the same time, the vibrator 10 is also pressed against the pile 6 with a predetermined vibrator pressure FV.

In the separator/feeder for sheets of paper-like medium illustrated in FIG. 1, the pile 6 is pressed by the takeout roller 3 and the vibrator 10 is by turn pressed against the pile 6 with a predetermined vibrator pressure FV. Then, as the vibrator 10 is driven to vibrate and the vibrations of the vibrator 10 are applied to the pile 6, the sheets of paper-like medium of the pile 6 become ready for being taken out one by one from the top. As the roller 3 is driven to operate in this state, the sheets of paper-like medium are fed out one by one in the direction indicated by arrow S in FIG. 1.

The experiment was conducted in a condition where the position of the takeout roller 3 of the separator/feeder for sheets of paper-like medium having the above-described configuration is fixed relative to the piled sheets 11 of paper-like medium and the pressure FE of the backup table 2 is made to change. In this experiment, the vibrator 10 is driven to vibrate at a frequency of 20 kHz and the pressure FV of the vibrator 10 is made to change and brought into contact with the uppermost surface of the sheets 11 of paper-like medium to observe the effect of the vibrations for loosening the sheets of paper-like medium. FIG. 2 summarily illustrates the results of the experiment. In FIG. 2, the vertical axis indicates the backup force FE and the horizontal axis indicates the vibrator pressure FV, whereas the regions R1, R2, R3 where a loosening effect is observed are indicated by respective broken lines. The broken line region R1 is a region where piled envelopes are loosened appropriately and the broken line region R2 is a region where piled official post cards are loosened appropriately, whereas the broken line region R3 is a region where piled picture postcards are loosened appropriately. From the results of the experiment shown in FIG. 2, it was found to be important that the pressure of the vibrator 10 is regulated appropriately according to the backup force FE and the state of adhesion of the sheets 11 of paper-like medium is controlled properly in order to achieve a good effect of loosening sheets 11 of paper-like medium by bringing the vibrator 10 into contact with the surface of the piled sheets 11 of paper-like medium and applying high frequency vibrations.

It was found that a good loosening effect can be achieved for any type of sheets in terms of size and thickness when the pressures are limited to a predetermined range as indicated in FIG. 2. In other words, it was found that a good loosening effect can be achieved for a variety of types of sheets 11 of paper-like mediums when an appropriate condition is defined for the pressures. Such an appropriate pressure may vary from machine to machine depending on the frequency and the amplitude of the vibrator 10, the design of the takeout roller 3 and other factors. From the above-described results of the experiment, it was found that a mechanism that can determine the pressures appropriately depending on machines is required to stably achieve a good loosening effect.

As seen from FIG. 2, it was also found that the vibrator 10 needs to be driven to vibrate sheets of paper-like medium with a frequency of an ultrasonic wave (a low frequency above the audible band or about 18 kHz to 28 kHz) and pressed against the sheets of paper-like medium with a pressure FV from 100 to 800 g, preferably from 180 to 450 g, with a backup force FE found within a range between 400 g and 1,200 g as requirements applicable to any type of paper-like medium.

When taking out sheets 11 of paper-like medium at high speed in a state where the vibrator 10 is held in contact with them, there arises a problem that the surface of the sheets 11 of paper-like medium is curved and deformed to show undulations. For example, when soft envelopes are to be loosened, the sheets 11 of paper-like medium is depressed and engaged with the vibrator 10 as they are pressed by the vibrator 10 so that it will be expected that they are fed in duplication and blocked by the vibrator 10 to give rise to tragic consequences. Additionally, it will be expected that the vibrator 10 cannot persistently follow the recessed or bulged surface of the pile 6 of sheets 11 of paper-like medium and jumps up to give rise to a situation where the vibrator 10 can no longer be stably held in contact with the sheets 11 of paper-like medium due to the relationship between the vibrator 10 and the proper vibration of the holding section holding the vibrator 10. It is important that the vibrator 10 is constantly held in contact with the sheets 11 of paper-like medium in order to apply vibrations and effectively achieve a good loosening effect. Therefore, it is important to prevent a situation where the vibrator 10 cannot be stably held in contact with the sheets 11 of paper-like medium.

In order to avoid such tragic consequences, it is necessary to variably control the pressure FV according to the position where the vibrator 10 contacts the surface of the sheets 11 of paper-like medium. More specifically, when the sheets 11 of paper-like medium are curved to produce a recess due to the pressure of the vibrator 10, it is necessary to control the vibrator 10 to reduce the pressure FV thereof in order to suppress the recess. When, on the other hand, the sheets 11 of paper-like medium are curved to produce a bulge that the vibrator 10 contacts, it is necessary to increase the pressure FV thereof in order to increase the contact area.

Now, this embodiment of separator/feeder for sheets of paper-like medium invented by the inventors of the present invention on the basis of the above observation will be described below. The separator/feeder for sheets of paper-like medium according to the embodiment comprises a mechanism for controlling the pressures FE and FV, a sensor for detecting the contact position of the vibrator 10 and a sensor for detecting the position of the uppermost surface of the piled sheets 11 of paper-like medium. Thus, it can control the pressures FE and FV.

Figure 3:
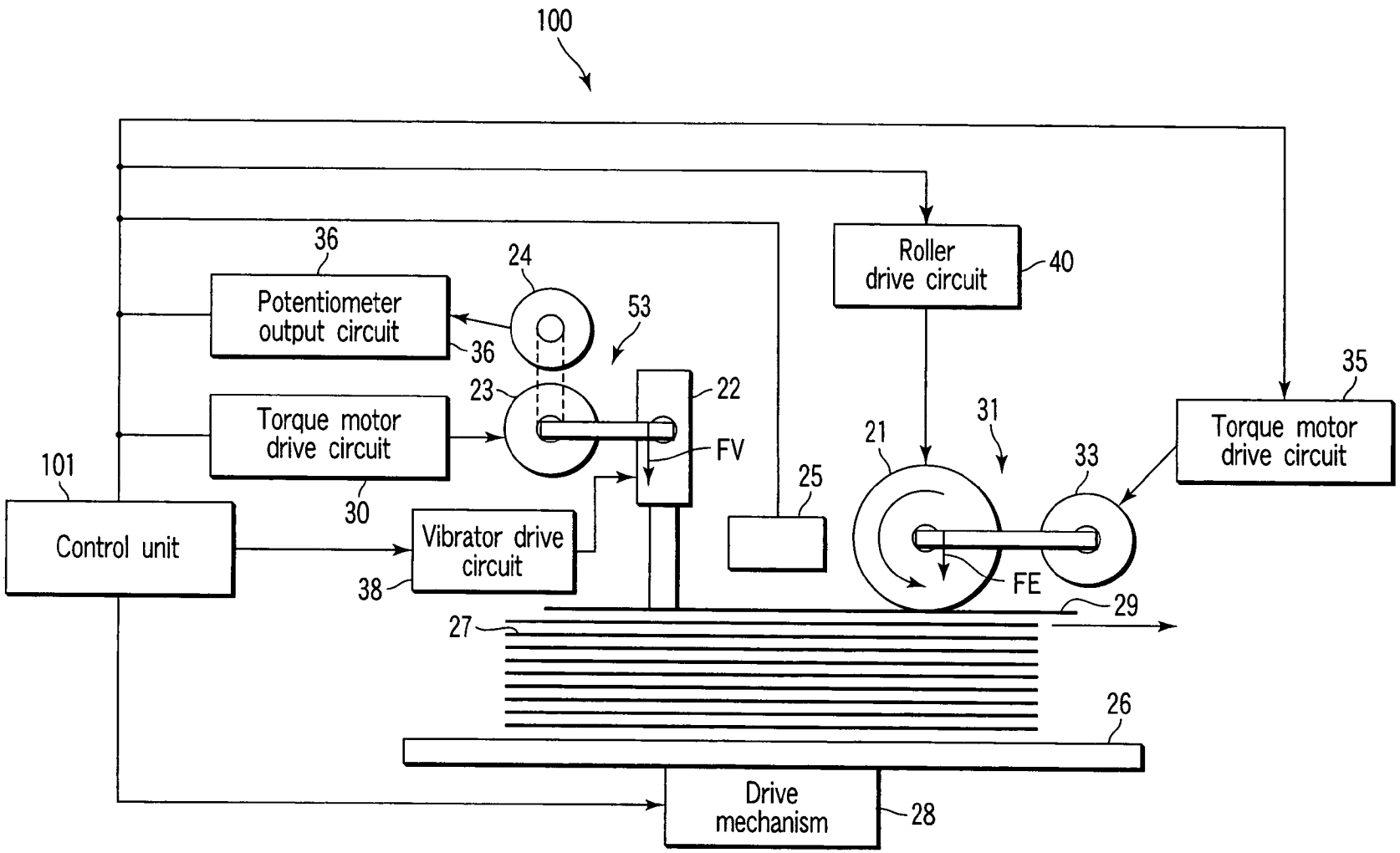
FIG. 3 is a schematic illustration of a first embodiment of separator/feeder for sheets of paper-like medium.

FIG. 3 is a schematic illustration of the first embodiment of separator/feeder 100 of sheets of paper-like medium. The separator/feeder 100 comprises a backup table 26 bearing and supporting a pile 27 of sheets of paper-like medium. The backup table 26 is driven to move up and down by a drive mechanism 28. Thus, the uppermost position of the pile 27 can be adjusted by means of the drive mechanism 28. The uppermost position of the pile 27 is detected by a non-contact sensor 25 such as an optical non-contact displacement gauge. A takeout roller 21 of a takeout/feed mechanism 31 for taking out an uppermost sheet 29 of paper-like medium of the pile 27 is held in contact with the pile 27. The takeout roller 21 is driven to rotate according to a drive signal from the roller drive circuit 40 and pressed against the pile 27 by means of a torque motor 33 of the feed mechanism 31. A vibrator 22 is arranged to apply vibrations to the pile 27 by way of its front end that is held in contact with the pile 27. The vibrator 22 is mechanically linked to a pressure adjustment mechanism 53 for pressing the vibrator 22 against the pile 27. Thus, the pressure applied to the pile 27 by the vibrator 22 can be adjusted by the pressure adjustment mechanism 53. The pressure adjustment mechanism 53 includes a torque motor 23 and pressure is provided to the vibrator 22 from the torque motor 23. Since the torque motor keeps on pressing the vibrator 22 with a constant turning effort, the motor stops rotating to keep on applying a constant pressure when the vibrator is held in contact with the surface of the medium. The torque motor 23 is connected to a potentiometer 24, which potentiometer 24 detects the position where the rotation of the torque motor 23 is stopped (rotational phase of the torque motor). The torque motors 23, 33 are driven by drive signals from respective torque motor drive circuits 30, 35. The detection signal of the potentiometer 24 is output from potentiometer output circuit 36 to a control unit 101. The control unit 101 controls the drive signal of the roller drive circuit 40 so as to drive the feed motor 21 to operate at a predetermined timing. The control unit 101 controls the outputs of the torque motors 23, 33 so as to respectively control the pressure adjustment mechanism 53 and the feed mechanism 31 and also controls the drive mechanism 28 so as to control the operation of driving the backup table 26 to move up and down. Additionally, the vibrator 22 is driven to operate by a drive signal from vibrator drive circuit 38, which vibrator drive circuit 38 is also controlled by the control unit 101.

Figure 4:
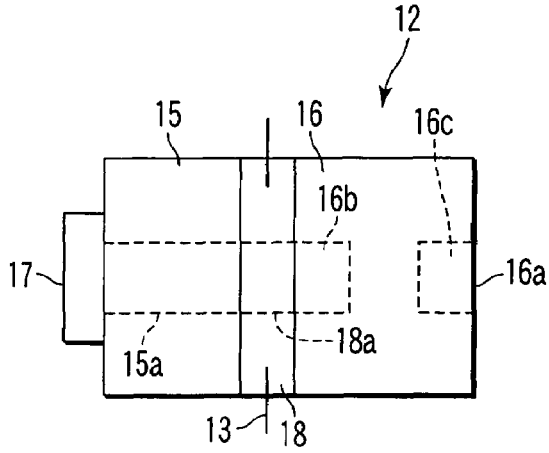
FIG. 4 is a schematic lateral view of the vibrating part of the vibrator of FIG. 3.
Figure 5:
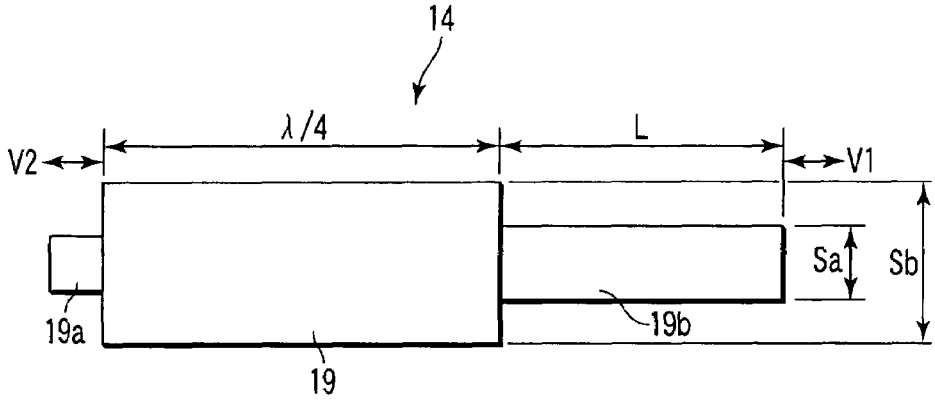
FIG. 5 is a schematic lateral view of the ultrasonic horn of the vibrator of FIG. 3.

The vibrator 22 is illustrated in FIG. 3 in a simplified form. It has a structure where a vibrating part 12 as shown in FIG. 4 is linked to an ultrasonic horn 14 as shown in FIG. 5. The vibrating part 12 is referred to as so-called bolt-held type vibrating part having a structure where a piezoelectric ceramic section 18, or a piezoelectric element, having electrodes extending from the inside to the outside thereof is held tightly in position between a pair of blocks 15, 16 by means of a bolt 17 as shown in FIG. 4. The cylindrical block 15 and the disk-shaped piezoelectric ceramic section 18 are provided respectively with central through holes 15*a*, 18*a*, which through holes 15*a*, 18*a* are threaded so as to be engaged with the bolt 17. The cylindrical block 16 is also provided with a recess/hole 16*b* at the center of the side of the piezoelectric ceramic section 18, which recess/hole 16*b* is also threaded so as to be engaged with the bolt 17. Thus, as the bolt 17 is driven into the through holes 15*a*, 18*a* of the cylindrical block 15 and the disk-shaped piezoelectric ceramic section 18 and the recess/hole 16*b* of the cylindrical block 16, the cylindrical block 15, the disk-shaped piezoelectric ceramic section 18 and the cylindrical block 16 are mechanically linked to each other.

In the vibrating part 12, as the disk-shaped piezoelectric ceramic section 18 is vibrated as a function of the drive voltage applied to the electrodes 13, the entire vibrating part 12 vibrates and the vibrations of the vibrating part 12 are transmitted to the vibration surface 16*a* of the cylindrical block 16. The amplitude of vibration of the piezoelectric ceramic section 18 is relatively small so that, if the ultrasonic vibrations of the vibration surface 16*a* of the cylindrical block 16 are taken out and applied to the surface of the pile 20, it is not possible to apply vibrations that are large enough for loosening the sheets 2. Thus, the vibrating part 12 is mechanically linked to the ultrasonic horn 14 in order to amplify the ultrasonic vibrations.

The vibration surface 16*a* of the cylindrical block 16 is provided with a threaded recess/hole 16*c* for the purpose of mechanically linking itself to the ultrasonic horn 14 shown in FIG. 5. The ultrasonic horn 14 is provided at the end facet of one of the opposite ends of cylindrical block section 19 thereof with a link section 19*a* to be engaged with the recess/hole 16*c*. As the link section 19*a* is driven into and engaged with the recess/hole 16*c*, the cylindrical block 16 and the cylindrical block section 19 are tightly brought into contact with each other and linked to each other. Thus, they become integral with each other. The total length of the cylindrical block section 19 is defined to be $\lambda/4$, where $\lambda$ is substantially equal to the vibration wavelength. An extension 19*b* having a diameter smaller than the diameter Sb of the cylindrical block section 19 is extended from the opposite end facet of the cylindrical block section 19. The front end of the extension 19*b* is made flat because it is brought into contact with the sheets 2. In the ultrasonic horn 14, the position of the opposite end of the cylindrical block section 19 is typically defined to be the position of the vibration mode ($\lambda/4$) and the diameter of the extension 19*b* extended from the opposite end is increased or decreased from that of the cylindrical block section 19 so that the amplitude of vibration transmitted through the cylindrical block section 19 is changed by the extension 19*b* and transmitted to the sheets 2 from the extension 19*b*.

With the above-described structure of the ultrasonic horn 14, the rate of vibration at the front end of the ultrasonic horn 14 is boosted to V1/V2=Sb/Sa. Due to such a structure of the ultrasonic horn 14, it is possible to produce a large amplitude at the front end thereof and apply a sufficient acceleration to the sheets (medium) 2. Note that V2 represents the rate of vibration transmitted to the cylindrical block 16 and V1 represents the rate of vibration output from the front end of the ultrasonic horn 14.

In an experiment where ultrasonic horns 14 having respective front end diameters of Sa=5 mm, 10 mm and 20 mm are alternately linked to a 20×60 mm vibrating part 12, it was proved that the vibration amplifying ratio Sb/Sa of the ultrasonic horn 14 is doubled. In this experiment, it was found that the friction reducing effect is strongest when Sa=5 mm. This is because, as the front end diameter of the ultrasonic horn 14 increases, the intra-planar vibration component increases relatively to obstruct the axial vibration component that operate for the vibrations. On the other hand, from the viewpoint of the contact of the ultrasonic horn 14 and the sheets (medium) 2, the contact pressure falls as the diameter Sa increases when the force applied to the sheets as pressure remains the same so that the risk of damaging the medium falls. Therefore, it was found that the front end diameter Sa of the horn is effective when it is between about 5 and 20 mm from a realistic viewpoint for designing the ultrasonic horn. It was proved that no friction reducing effect is achieved when a vibrating part 12 is used without an ultrasonic horn 14.

With the above-described vibrator 22, as the ultrasonic horn 14 is pressed against the top of the piled sheets (pile) 20, both the friction between the front end of the ultrasonic horn 14 and the uppermost sheet 2 and the friction between the upper most sheet 2 and the sheet 2 of the pile under it fall sufficiently so that it is possible to separate and bring out the uppermost sheet without duplication.

Figure 6:
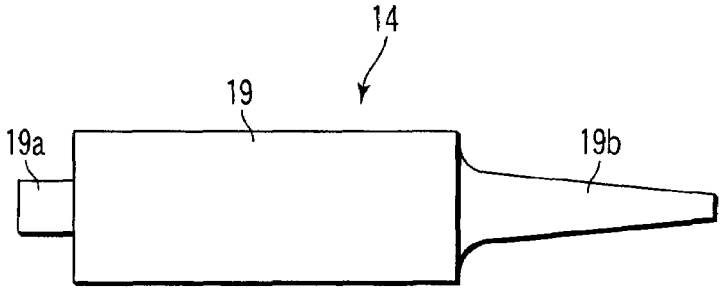
FIG. 6 is a schematic lateral view of an ultrasonic horn obtained by modifying the ultrasonic horn of the vibrator of FIG. 3.
Figure 7:
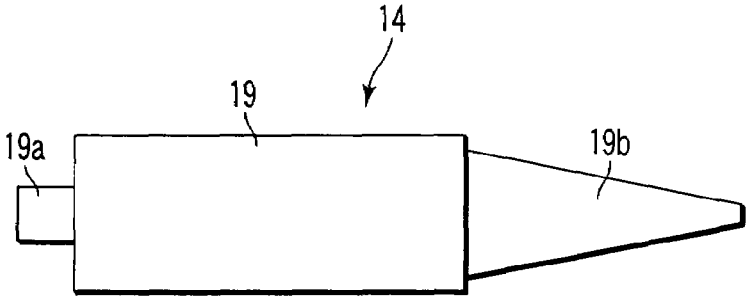
FIG. 7 is a schematic lateral view of another ultrasonic horn also obtained by modifying the ultrasonic horn of the vibrator of FIG. 3.

While a titanium alloy that is hard and least subjected to fatigue/failure is most suitable as the material of the ultrasonic horn 14, an aluminum alloy or a nickel alloy may also be used depending on the frequency of use and other conditions. The profile of the ultrasonic horn 14 is not limited to the one illustrated in FIG. 5, where a large diameter cylindrical block and a small diameter cylindrical block are aligned and linked to each other along the same axial line with a step formed between them. For example, the diameter of the extension 19*b* may be decreased not abruptly but gradually toward the front end thereof as shown in FIGS. 6 and 7. More specifically, the extension 19*b* may be tapered from the cylindrical block 19 to show a curved profile as illustrated in FIG. 6. Alternatively, the extension 19*b* may be tapered linearly from the cylindrical block 19 as illustrated in FIG. 7.

While the contact area of the front end of the ultrasonic horn 14 is normally made to show a flat profile, it may be rounded when it can damage the medium, when its resistance is too strong and/or when it can catch an envelope at a small step of the latter. Additionally, the contact area of the front end of the ultrasonic horn 14 preferably does not have any undulations.

In the separator/feeder 100 of sheets of paper-like medium as shown in FIG. 3, firstly the drive mechanism 28 is driven to operate and raise the backup table 26 bearing a pile 27 of sheets of paper-like medium thereon under the control of the control unit 101. Then, as a result, both the takeout roller 21 and the vibrator 22 press the uppermost surface of the pile 27. Then, drive signals are applied respectively from the torque motor drive circuits 35, 30 to the torque motors 23, 33 to drive the torque motors 23, 33 so as to adjust the pressure between the vibrator 22 and the pile 27 and the pressure between the takeout roller 21 and the pile 27 under the control of the control unit 101. Under this condition, the vibrator 22 starts vibrating according to the drive signal from the vibrator drive circuit 38. Thus, the vibrator 22 vibrates with a frequency in an inaudible zone not lower than 18 kHz while pressing the pile 27. Then, as a result, the sheets 29 of paper-like medium of the pile 27 are loosened by the vibrations applied to them from the vibrator 22. Thereafter, the takeout roller 21 is pressed against the pile 27 due to the turning effort of the torque motor 33. The takeout roller 21 is driven to rotate according to the signal from the roller drive circuit 40 while pressing the sheets 29 of paper-like medium. Thus, the sheets 29 of paper-like medium are sequentially scraped off from the pile 27 as the uppermost sheet and delivered in the sense of rotation of the takeout roller 21 due to the frictional force between the takeout roller 21 and the sheets of paper-like medium.

The torque motors 23, 33 are controlled by the control unit 101 for their rotary torque and the takeout roller 21 and the vibrator 22 are pressed against the sheets 29 of paper-like medium by predetermined respective forces. The potentiometer 24 indirectly detects the position of the vibrator as it is connected to the torque motor 23, which is by turn connected to the vibrator 22, to detect the rotational halting position of the torque motor 23 and outputs a detection signal that corresponds to the observed value to the control unit 101.

Figure 8:
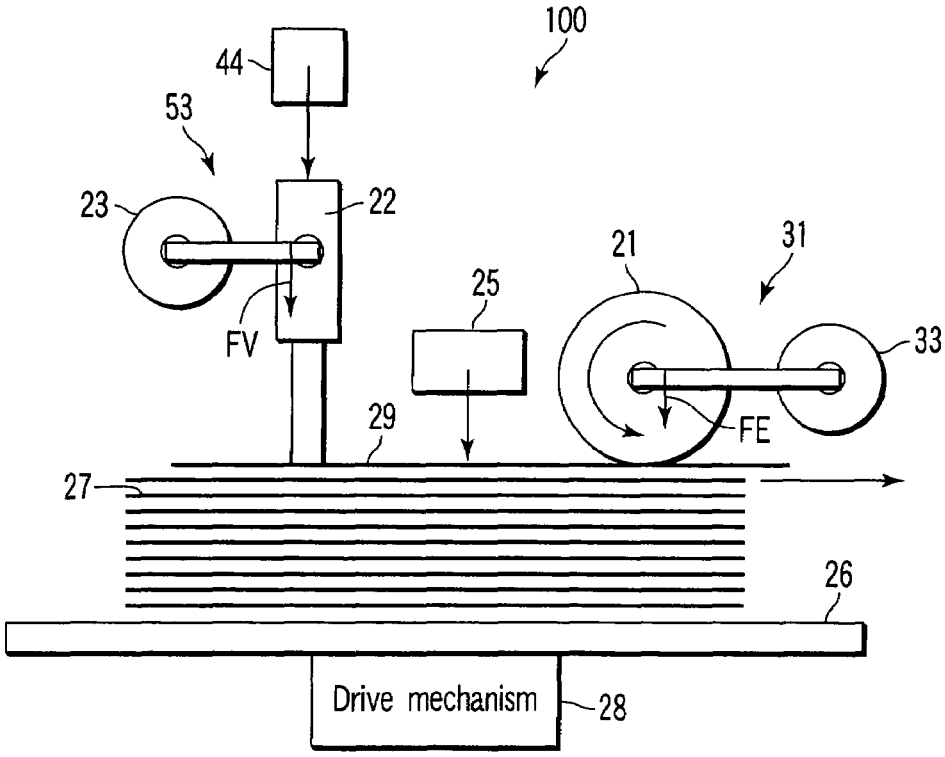
FIG. 8 is a schematic illustration of a separator/feeder obtained by modifying the embodiment of separator/feeder for sheets of paper-like medium of FIG. 3.

The potentiometer 24 may be replaced by an optical position sensor 44 to directly observe the position of the vibrator 22 as shown in FIG. 8. In the separator/feeder 100 of sheets of paper-like medium illustrated in FIG. 8, the non-contact displacement gauge 25 detects the position of the uppermost surface of the pile of sheets of paper-like medium and outputs the observed value to the control unit 101. The backup table 26 that operates as holding section bears a pile 27 of sheets of paper-like medium and holds the lowermost surface of the pile 27 of sheets of paper-like medium. The drive mechanism 28 for driving the backup table 26 actuates the backup table 26 according to the output of the control unit 101 to control the position of the uppermost surface of the pile 27 of sheets of paper-like medium. The control unit 101 is connected to the torque motor 23, the optical position sensor 44, the non-contact displacement gauge 25 and the drive mechanism 28 and controls the rotary torque of the torque motor 23 and the operation of the drive mechanism 28 according to the inputs from the optical position sensor 44 and the non-contact displacement gauge 25.

In the separator/feeder 100 of sheets of paper-like medium illustrated in FIG. 8, the vibrator 22 is also vibrated by a drive signal from the vibrating part drive circuit 38 so that it vibrates while pressing the pile 27. Thus, as a result, the sheets 29 of paper-like medium of the pile 27 are loosened by the vibrations applied by the vibrator 22 and the takeout roller 21 is driven to rotate by the turning effort of the torque motor 33 according to the signal from the roller drive circuit 40, while pressing the pile 27. Then, the sheets 29 of paper-like medium are sequentially scraped off from the pile 27 as the uppermost sheet and delivered in the sense of rotation of the takeout roller 21 due to the frictional force between the takeout roller 21 and the sheets 29 of paper-like medium.

The torque of the torque motor 23 is set to such a value that the pressure of the takeout roller 21 and that of the vibrator 22 that are applied to the sheets of paper-like medium get to respective target values. The optimum pressure of the takeout roller 21 and that of the vibrator 22 are defined in advance by referring to the results of one or more than one experiments conducted for the effect of loosening sheets of paper-like mediums because they are variable depending on the machine and the vibrator. For example, from the results of the experiment illustrated in FIG. 2, it is preferable that the pressure FE of the takeout roller is defined to be within a range between 600 [gf] and 900 [gf] and the pressure FV of the vibrator 22 is defined to be within a range between 200 [gf] and 350 [gf]. Therefore, the torque of the torque motor 23 is controlled so as to confine the pressures FE and FV within the respective ranges.

Figure 9:
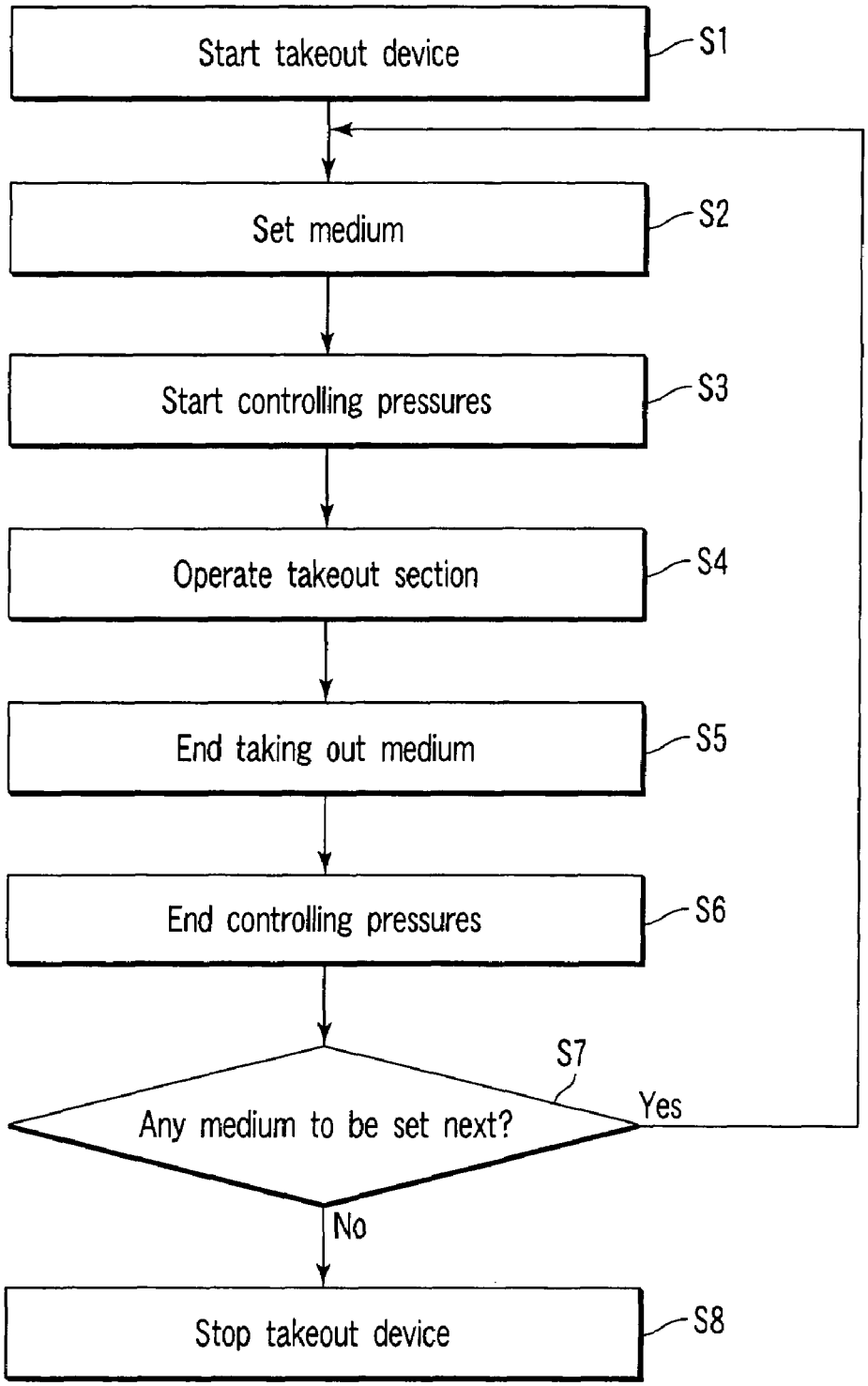
FIG. 9 is a flowchart of the separation/feed operation of the separator/feeder of FIG. 3.

Now, the operation of the separator/feeder 100 for separating and taking out sheets of paper-like medium from a pile of sheets will be described below by referring to the flowchart of FIG. 9. Firstly, in Step S1, the control unit 101 starts the separator/feeder 100 of sheets of paper-like medium. When no sheet 27 of paper-like medium is found on the backup table 26, a pile 27 of sheets of paper-like medium to be processed is set on the backup table 26 by an operator as indicated by Step S2. Subsequently, in Step S3, the control unit 101 starts controlling the separator/feeder. In Step S4, the control unit 101 sets the pressures FV, FE and the vibrator 22 is operated while applying the pressure FV to the sheets 29 of paper-like medium, whereas the pressure FE is also applied to the sheets 29 of paper-like medium and the operation of the takeout roller 21 for taking out the sheets 29 of paper-like medium is started as the position of taking out the sheets 29 of paper-like medium of the takeout roller 21 is controlled. Thus, the sheets 29 of paper-like medium are taken out sequentially. As the operation of taking out the sheets 29 of paper-like medium ends in Step S5, the control unit 101 controls the operation of controlling the set pressures FV, FE and the position of taking out sheets 29 of paper-like medium in Step S6. In Step S7, it is determined if a sheet 29 of paper-like medium to be taken out next is still found or not and the process returns to Step S2 when there is a sheet 29 of paper-like medium to be taken out. If there is not any sheet 29 of paper-like medium to be taken out, control unit 101 stops the separator/feeder 100 of sheets of paper-like medium and ends the process in Step S8.

Now, the operation of controlling the pressures of Step S4 shown in FIG. 9 will be described in greater detail below.

The pressures FV, FE are controlled according to the undulations of the sheets 29 of paper-like medium. More specifically, each time a sheet 29 of paper-like medium is taken out, the position of the vibrator 22 and the uppermost position of the sheets 29 of paper-like medium are compared to detect undulations, if the sheets 29 of paper-like medium. For the comparison, either a technique of comparing relative positions for a change or a technique of comparing absolute values of the positions is used. These two techniques will be described in greater detail below.

Referring to FIGS. 10A to 10D, the technique of controlling the pressures by comparing relative positions for a change will be described firstly. With the technique of comparing the relative positions for a change, the quantity of the positional move of the vibrator 22 between before and after taking out the uppermost sheet 29 of paper-like medium is detected by the sensor 24 or 44 and the quantity of the displacement of the uppermost sheet 29 of paper-like medium is detected by the sensor 25 and the quantity of the positional move and the quantity of the displacement are compared.

Figure 10A:
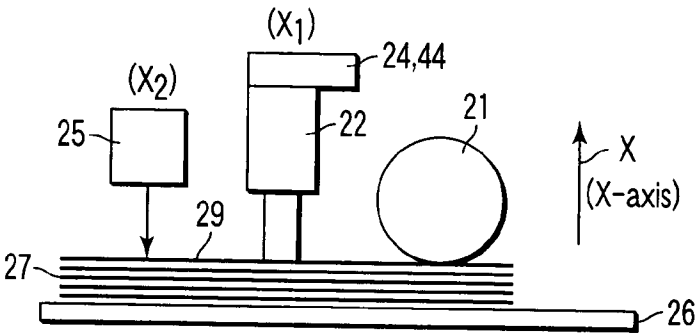
FIGS. 10A to 10D are schematic illustrations of the method of controlling pressure by comparing relative positional changes in the separator/feeder of FIG. 3.

Firstly, as shown in FIG. 10A, the takeout roller 21 is stopped and the position of the vibrator 22 before the uppermost sheet 29 of the pile of sheets of paper-like medium is taken out is detected. In other words, the sensor 24 or 44 detects the contact position $X_1$ of the vibrator 22 in a state where the vibrator 22 is held in contact with the uppermost surface of the pile 27 of sheets of paper-like medium and outputs the detection output $X_1$. Similarly, the sensor 25 measures the height $X_2$ of the uppermost surface of the sheets 29 of paper-like medium and outputs the measurement output $X_2$.

In FIGS. 10A to 10D, the X-axis indicates the direction perpendicular to the uppermost surface of the pile 27 of sheets of paper-like medium and the upward direction as indicated by arrow X (which corresponds to the X-axis) is the positive direction.

Figure 10B:
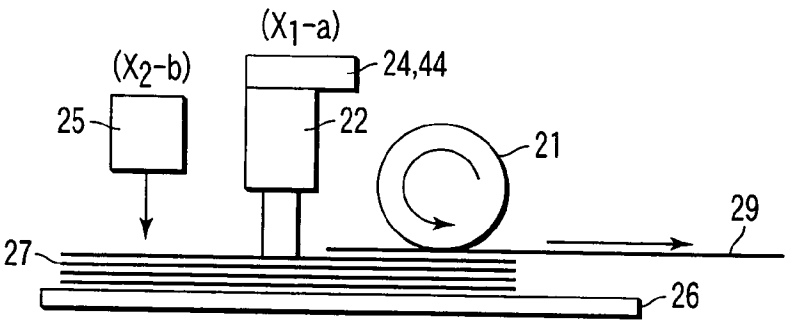

Then, as shown in FIG. 10B, the takeout roller 21 rotates to start taking out the uppermost sheet 29 of paper-like medium and the uppermost sheet 29 of paper-like medium is removed from the contact point of the vibrator 22 and the detection point of the sensor 25. In the state where the uppermost sheet 29 of paper-like medium in FIG. 10A is removed as shown in FIG. 10B, the sensor output changes and the vibrator 22 is lowered by the quantity of displacement a so that the sensor 24 or 44 outputs the sensor output $(X_1-a)$. Similarly, as the detection point on the uppermost surface of the sheets of paper-like medium of the pile 27 falls by the displacement b, the sensor 25 outputs the sensor output $(X_2-b)$.

Figure 10C:
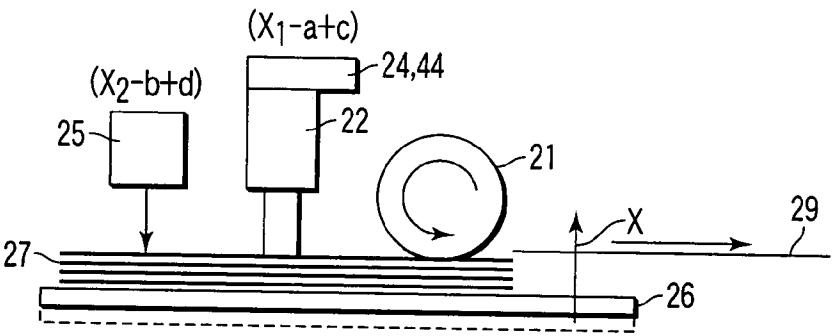

FIG. 10C shows the state where the uppermost sheet 29 of paper-like medium is completely taken out and the backup table 26 is raised in the direction of arrow X so that the height of the uppermost surface of the sheet 29 of paper-like medium of the pile 27 is adjusted. The sensor output changes in this state. If the state of FIG. 10B is switched to the state of FIG. 10C and the vibrator 22 is raised by the quantity of displacement c, the sensor output of the sensor 44 is changed to output $(X_1-a+c)$. As the uppermost surface detection point is raised by the quantity of displacement d, the sensor output of the sensor 25 is changed to output $(X_2-b+d)$. In other words, the quantity of the change $\Delta X_1$ of the position of the vibrator 22 and the quantity of the change $\Delta X_2$ of the uppermost surface position before and after the uppermost sheet 29 of paper-like medium is taken out are respectively $(-a+c)$ and $(-b+d)$.

By paying attention to the value of the quantity of the change $\Delta X_1$, it will be found that the displacement a is increased and the displacement c is decreased so that the quantity of change $\Delta X_1$ is decreased when the sheet 29 of paper-like medium that is used to be the second sheet and newly becomes the uppermost sheet after taking out the former uppermost sheet 29 of paper-like medium is soft and the vibrator 22 is driven into the sheets 29 of paper-like medium. When, on the other hand, the contact section of the vibrator 22 contacts a hard raised part of the second sheet 29 of paper-like medium and pushed up by the latter, the displacement a is decreased and the displacement c is increased so that the quantity of change $\Delta X_1$ is increased. Meanwhile, the sensor for detecting the uppermost surface position detects the position in such a way that it does not touch or touches the top surface only very weakly and hence does not press down the top surface of the sheets of paper-like medium so that the quantity of change $\Delta X_2$ does not change depending on the type of sheets of paper-like medium. Thus, it is possible to determine the state of being raised or lowered of the contact point of the vibrator 22 by comparing the quantity of change $\Delta X_1$ and the quantity of change $\Delta X_2$. If it is found that $\Delta X_1<\Delta X_2$ as a result of the comparison, the vibrator 22 is driven into the sheets of paper-like medium. If, on the other hand, it is found that $\Delta X_1>\Delta X_2$, the vibrator 22 is pushed up by a raised section of the surface of the sheets of paper-like medium. Thus, the pressure FV of the vibrator 22 is determined according to the value of ($\Delta X_1 - \Delta X_2$). Once the pressure FV is determined, the values of the positions $X_1$, $X_2$ are quickly reset.

Figure 10D:
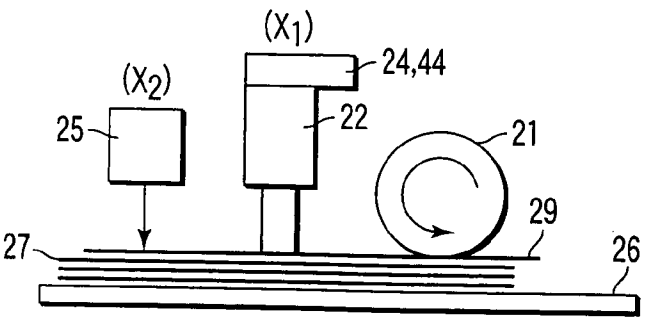

FIG. 10D shows a state where the values of the sensor outputs $X_1$, $X_2$ are reset and the operation of taking out the sheet 29 of paper-like medium that newly becomes the uppermost sheet is started after determining the pressure. From the state of FIG. 10D, the sheet 29 of paper-like medium is taken out as shown in FIGS. 10B and 10C and the pressure FV is determined once again. The operation of sequentially taking out sheets of paper-like medium is conducted as a result of repeating the above-described control operation.

In the description given above by referring to FIGS. 10A through 10D, it is assumed for the sake of convenience that the uppermost sheet 29 of paper-like medium does not show any undulations in the state of FIG. 10A to describe the control process of the control unit for successively taking out sheets 29 of paper-like medium. When taking out a sheet 29 of paper-like medium for the first time after starting the separator/feeder, the values of the sensor outputs $X_1$ and $X_2$ are reset immediately before starting the takeout operation. Then, the quantity of change $\Delta X_1$ and the quantity of change $\Delta X_2$ are observed and the pressure FV to be applied to the uppermost sheet 29 of paper-like medium is determined when the backup table 26 is raised to set the uppermost sheet 29 of paper-like medium to be taken out first in position.

Figure 11:
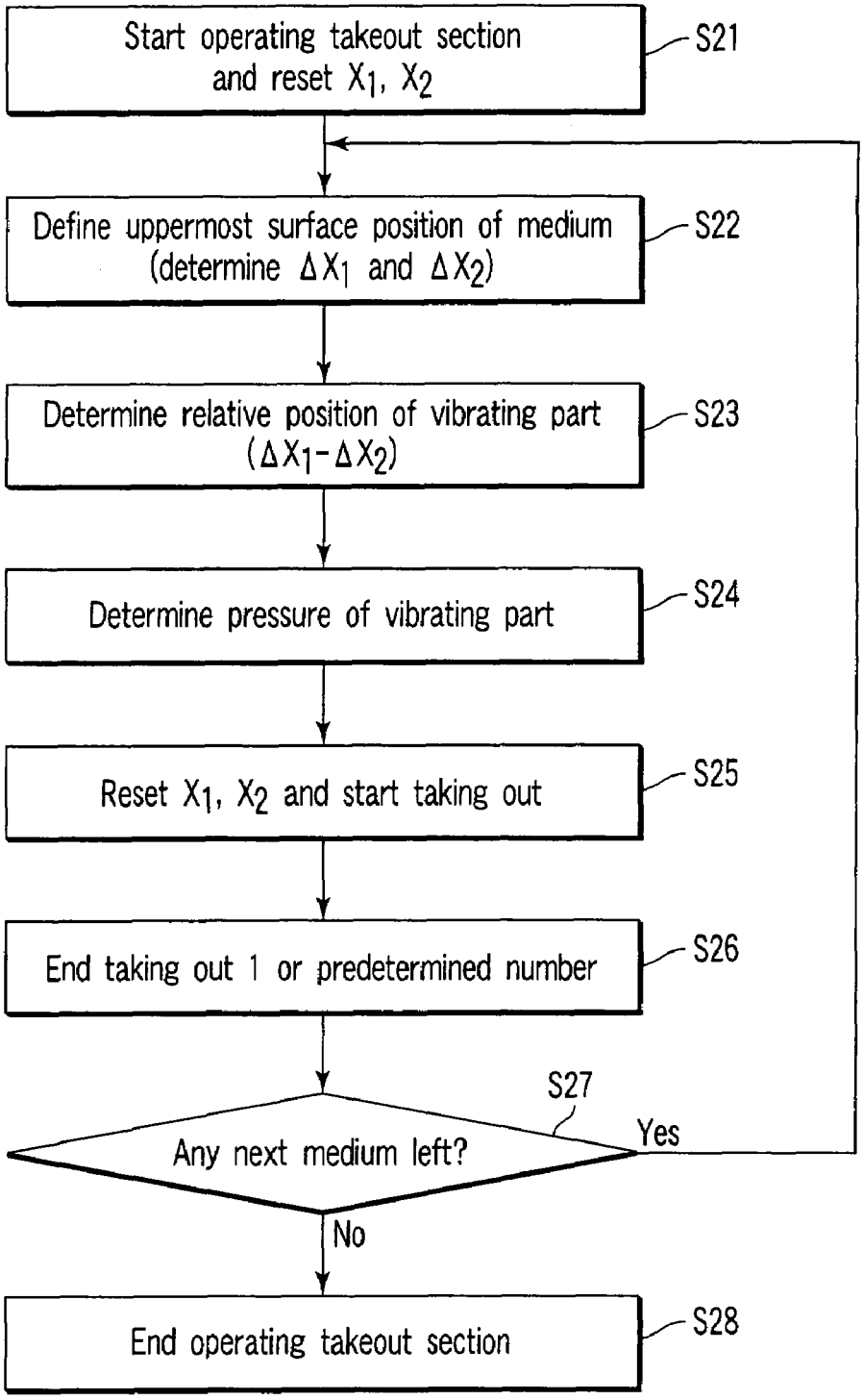
FIG. 11 is a flowchart of the operation of controlling the pressure of the vibrator of the separator/feeder of FIG. 3 according to the outcome of comparison of relative positional changes in the separator/feeder.

FIG. 11 is a flowchart of the operation of controlling the pressure FV of the vibrator 22 according to the outcome of the above-described comparison of the relative positions for a change. Referring to FIG. 11, as the takeout operation is started in Step S21 after starting the separator/feeder, the sensor output $X_1$ and the sensor output $X_2$ are set to the respective initial values. Then, the sheets 29 of paper-like medium are moved by the backup table 26 in Step S22 and the position of the uppermost surface of the sheets 29 of paper-like medium is set. At this time, the quantity of displacement $\Delta X_1$ and the quantity of displacement $\Delta X_2$ are detected. Then, the difference between the quantity of displacement $\Delta X_1$ and the quantity of displacement $\Delta X_2$ is computed and the relative position of the vibrator 22 is determined in Step S23. Thereafter, the pressure FV of the vibrator 22 is determined by means of a function (a function where the quantities of displacement are variables) according to the outcome of the computation of the difference of the quantities of displacement ($\Delta X_1 - \Delta X_2$) in Step S24. If, for example, the difference of the quantities of displacement is negative ($\Delta X_1 - \Delta X_2 = -1$ mm) and a recess is formed on the piled sheets 29 of paper-like medium, the pressure FV that is normally 250 [gf] may be reduced to 100 [gf]. If, on the other hand, the difference of the quantities of displacement is positive ($\Delta X_1 - \Delta X_2 = 1$ mm) and a bulge is formed on the piled sheets 29 of paper-like medium, the pressure FV that is normally 250 [gf] may be raised to 300 [gf]. The function that is required in Step S24 is appropriately defined according to the specifications of the separator/feeder. After the quantities of displacement $\Delta X_1$, $\Delta X_2$ are reset, an operation of taking out the uppermost sheet 29 of paper-like medium is started in Step S25. After ending the operation of taking out the uppermost sheet 29 of paper-like medium in Step S26, it is determined if there is still a sheet of paper-like medium to be taken out successively or not in Step S27. The end of the operation of taking out the uppermost sheet 29 of paper-like medium in Step S25 is defined appropriately depending on the situation. In other words, the operation may be ended when only a sheet 29 of paper-like medium is taken out or only when a predetermined number of sheets 29 of paper-like medium are taken out. If it is found in Step S27 that there is still a sheet 29 of paper-like medium to be taken out successively, the process returns to Step S22 and the position of the uppermost surface of the sheets 29 of paper-like medium is adjusted once again. If, on the other hand, it is found in Step S27 that there is not any sheet 29 of paper-like medium to be taken out, the takeout operation of the separator/feeder is ended in Step S28.

Figure 12A:
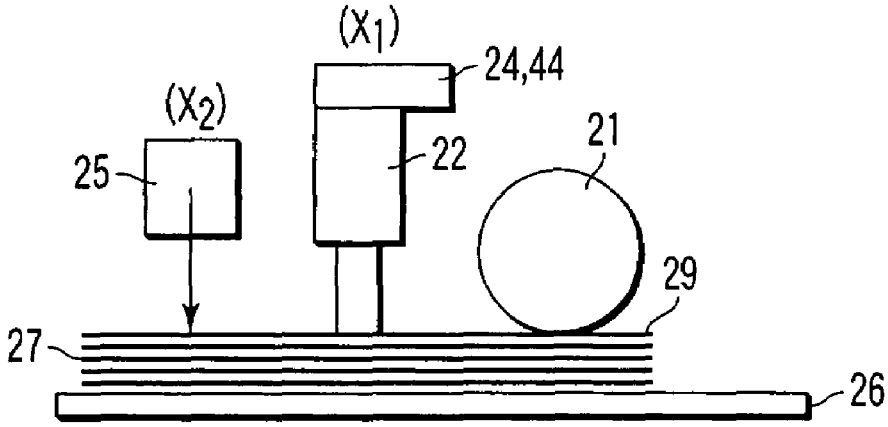
FIGS. 12A and 12B are schematic illustration of the method of comparing the absolute value of the position of the vibrator and that of the position of the uppermost surface of sheets of paper-like medium in the separator/feeder of FIG. 3.
Figure 12B:
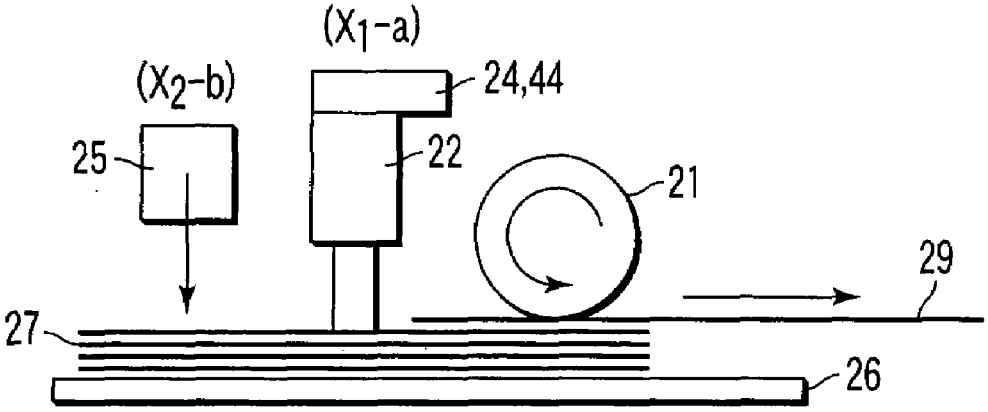

FIGS. 12A and 12B are schematic illustration of the technique of comparing the position of the vibrator 22 and the position of the uppermost surface of sheets 29 of paper-like medium in terms of absolute value. The position of the vibrator 22 immediately before the uppermost sheet 29 of paper-like medium is take out is detected by the sensor 24 or 44 and the uppermost position of the sheets 29 of paper-like medium is detected by the sensor 25 so that the sensor outputs of the two sensors 24 or 44 and the sensor 25 are compared with each other.

FIG. 12A illustrates a state where the vibrator 22 touches the uppermost surface of the piled sheets 29 of paper-like medium and the front end position thereof $X_1$ is detected by the sensor 44 so that the sensor output $X_1$ is output, while the position of the uppermost surface $X_2$ of the pile 27 of sheets of paper-like medium is detected by the sensor 25 so that the sensor output $X_2$ is output. The direction perpendicular to the uppermost surface of the pile 27 of sheets of paper-like medium is the direction of the X-axis. The numerical values of the sensor outputs $X_1$, $X_2$ immediately before the uppermost sheet of the pile 27 of sheets of paper-like medium is taken out is read in and compared to detect the undulations, if the pile 27 of sheets of paper-like medium that the vibrator 22 touches. More specifically, if the sensor output $X_1$ is smaller than the sensor output $X_2$ ($X_1 < X_2$), the part where the vibrator 22 touches the pile 27 of sheets of paper-like medium is depressed. If, on the other hand, the sensor output $X_1$ is greater than the sensor output $X_2$ ($X_1 > X_2$), the part where the vibrator 22 touches the pile 27 of sheets of paper-like medium is raised. Thus, the pressure of the vibrator 22 is determined according to the difference of the sensor outputs $X_1$, $X_2$. For example, if the difference of the sensor outputs $X_1$, $X_2$ is negative ($X_1 - X_2 = -1$ mm), the pressure of the vibrator 22 that is normally 250 [gf] may be decreased to 100 [gf]. If, on the other hand, the difference of the sensor outputs $X_1$, $X_2$ is positive ($X_1 - X_2 = 1$ mm), the pressure of the vibrator 22 that is normally 250 [gf] may be increased to 300 [gf].

After the pressure FV is determined, the uppermost sheet 29 of paper-like medium is taken out from the pile 27 of sheets of paper-like medium in the state where the pile 27 of sheets of paper-like medium is being vibrated. As the operation of taking out the uppermost sheet 29 of paper-like medium ends as shown in FIG. 12B, the position of the uppermost surface of the sheets 29 of paper-like medium is put back to the state of FIG. 12A. Then, the process where the numerical values of the sensor outputs $X_1$, $X_2$ immediately before the uppermost sheet of the pile 27 of sheets of paper-like medium is taken out is read in and the pressure FV is set is repeated.

Figure 13:
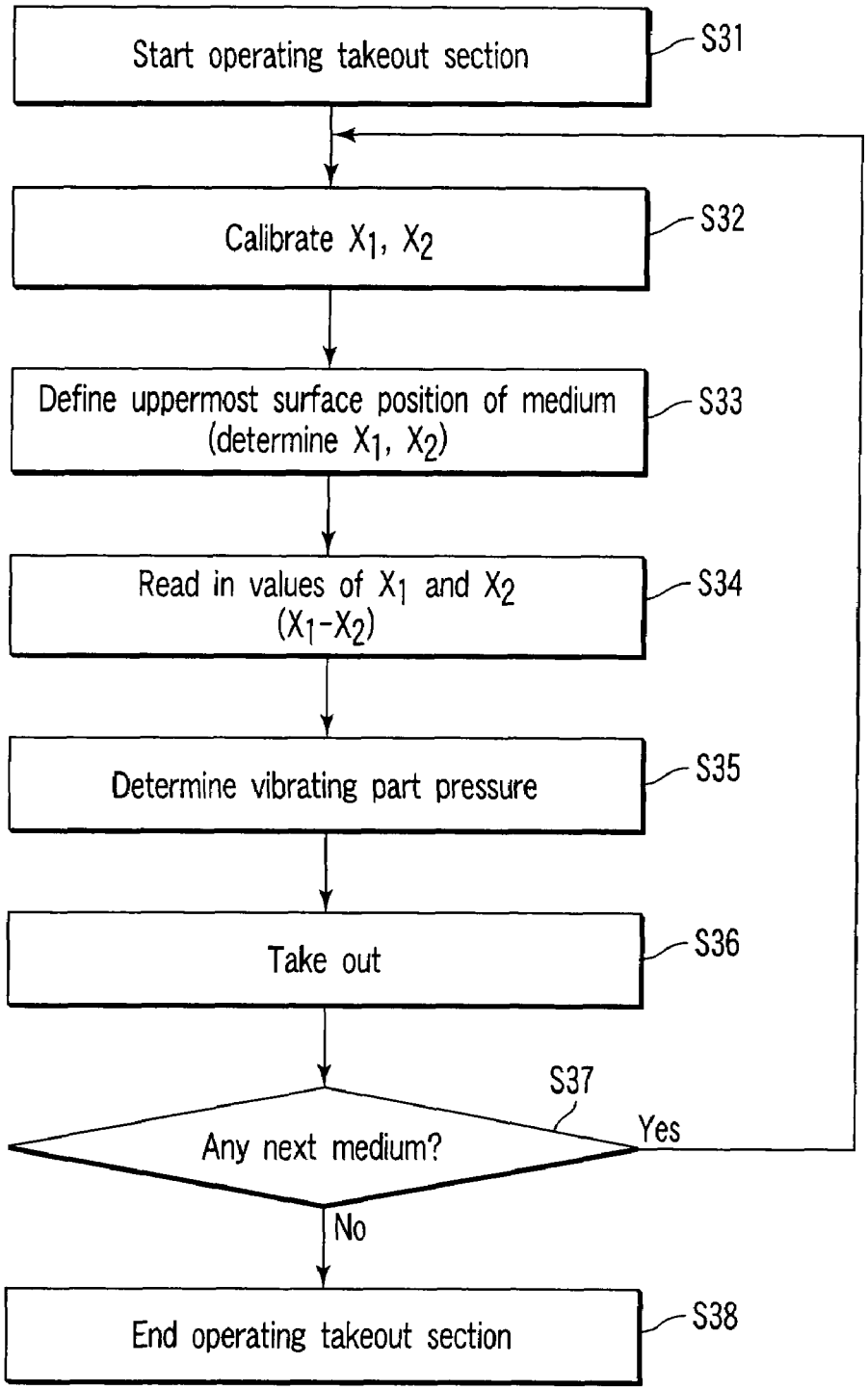
FIG. 13 is a flowchart of the operation of controlling the pressure of the vibrator of the separator/feeder of FIG. 3 according to the outcome of comparison of positions in terms of absolute values in the separator/feeder.

The process of controlling the pressure FV of the vibrator 22 according to the outcome of the comparison of the positions in terms of absolute value will be described by way of the flowchart of FIG. 13. After the control unit 101 starts to operate the separator/feeder and the operation of taking out a pile 27 of paper-like medium is started in Step S31, the values of the sensor outputs $X_1$, $X_2$ are calibrated also in Step S32. Then, in Step S33, the pile 27 of paper-like medium are moved by the backup table 26 and the position of the uppermost surface of the pile 27 of paper-like medium is determined. Then, the values of the sensor outputs $X_1$, $X_2$ are detected in Step S34 and the pressure FV of the vibrator 22 is determined by means of a function that is defined according to the specifications of the separator/feeder depending on the different of the sensor outputs $X_1$, $X_2$ in Step S35. Thereafter, a sheet 29 of paper-like medium is or a predetermined number of sheets 29 of paper-like medium are taken out in Step S36. When the operation of taking out a sheet 29 or the predetermined number of sheets 29 of paper-like medium ends, it is determined if there is a sheet 29 of paper-like medium to be taken out successively or not in Step S37. If there is a sheet 29 of paper-like medium to be taken out successively, the process returns to Step S33 and the uppermost position of the pile 27 of paper-like medium is adjusted. If, on the other hand, it is found in Step S37 that there is not any pile 27 of paper-like medium to be taken out, the sheet taking out operation ends in Step S38.

Figure 14:
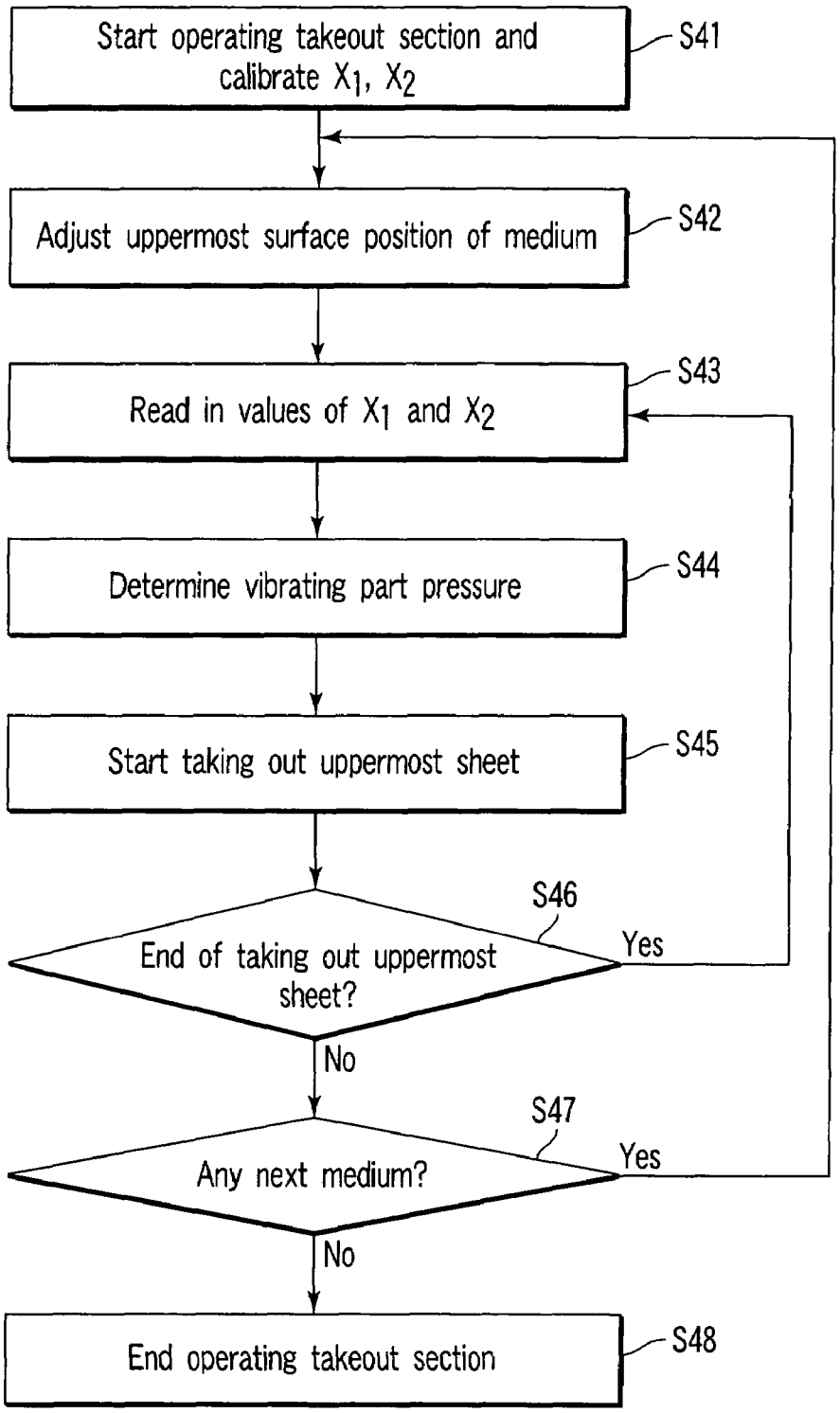
FIG. 14 is a flowchart of the operation of continuously comparing the sensor outputs and controlling pressure in the separator/feeder of FIG. 3.

With this technique of comparing the positions in terms of absolute value, the values of the sensor outputs $X_1$, $X_2$ may be continuously compared with each other to constantly control the pressure FV. FIG. 14 is a flowchart of the process of constantly controlling the pressure FV. With the technique of continuously comparing the output values, after the control unit 101 starts to operate the separator/feeder and the operation of taking out a sheet 29 of paper-like medium is started in Step S41, the values of the sensor outputs $X_1$, $X_2$ are calibrated also in Step S41. Then, in Step S42, the position of the uppermost surface of the sheets 29 of paper-like medium is adjusted and defined by the backup table 26. Then, the values of the sensor outputs $X_1$, $X_2$ are detected in Step S43 and the pressure FV of the vibrator 22 is determined to a predetermined value according to the difference of the sensor outputs $X_1$, $X_2$ and by means of a function that is defined according to the specifications of the separator/feeder in Step S44. Then, in Step S45, the operation of taking out the uppermost sheet 29 of paper-like medium is started by the takeout roller 21. When it is found in Step S46 that the uppermost sheet 29 of the paper-like medium has not been taken out yet, the process returns to Step S43 and the pressure of the vibrator 22 is redetermined. When, on the other hand, it is found in Step S46 that the uppermost sheet 29 of the paper-like medium has already been taken out, it is determined in Step S47 if there is the next sheet 29 of paper-like medium to be taken out or not. If it is determined in Step S47 that there is the sheet 29 to be taken out, the process returns to Step S42 to adjust the uppermost position of the sheets 29 of paper-like medium. If, on the other hand, it is determined in Step S47 that there is not any sheet 29 to be taken out, the sheet taking out operation ends in Step S48. The cycle period of the loop from Step S43 to Step S46 is determined so as to make the process most optimum depending on the separator/feeder.

With the above-described techniques, the pressure of the vibrator 22 is so controlled as to bring the uppermost surface of the sheets 29 of paper-like medium and hence the sensor output $X_1$ of the sensor 25 to a constant level when the backup table 26 is raised and the uppermost position of the sheets 29 of paper-like medium is moved. However, the present invention is by no means limited to such a control process. Alternatively, the control process may be such that the backup table 26 is not moved and held to a fixed position and a feed mechanism 31 including the vibrator 22 and the takeout roller 21 is moved toward the sheets 29 of paper-like medium until the feed mechanism 31 touches the uppermost surface of the sheets 29 of paper-like medium as shown in FIG. 15.

Figure 15:
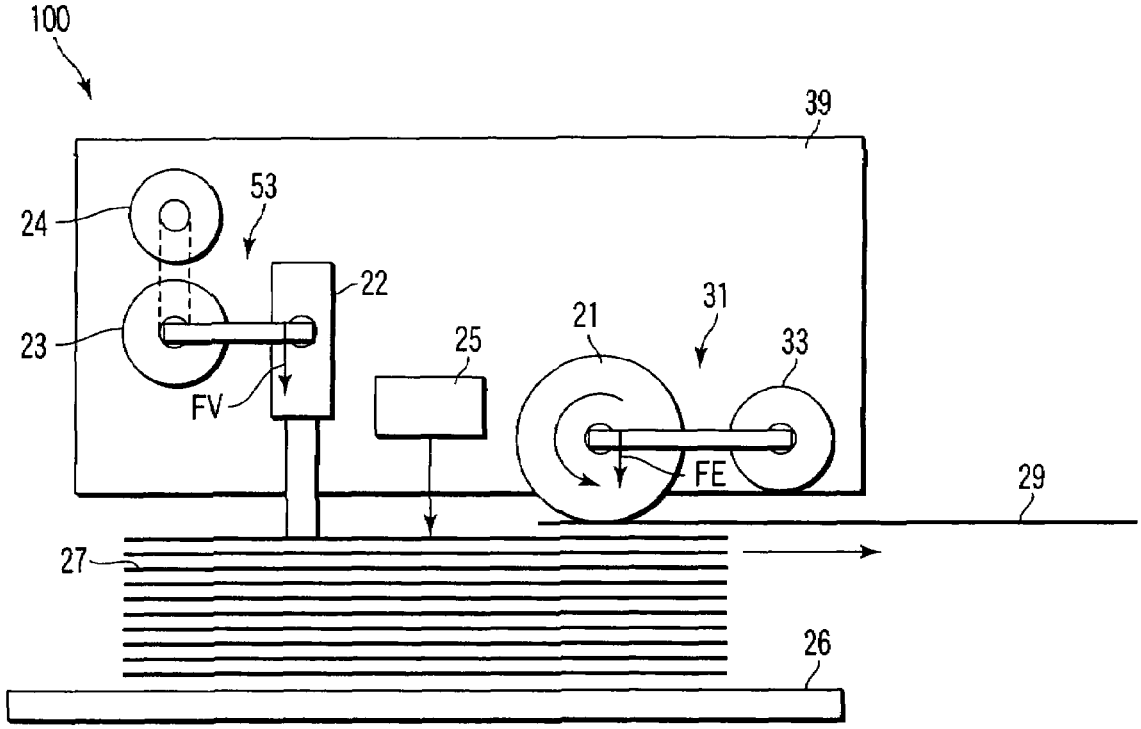
FIG. 15 is a schematic illustration of a separator/feeder obtained by modifying the separator/feeder of FIG. 3.

With the separator/feeder of FIG. 15, the feed mechanism 31 is mounted on a holding/moving mechanism 39 and controlled by the mechanism 39 so as to be movable toward the sheets 29 of paper-like medium. More specifically, as shown in FIG. 15, the feed mechanism 31 including the vibrator 22, the torque motor 23, the potentiometer 24, the non-contact displacement sensor 25 is mounted on and anchored to the moving mechanism 39 and the moving mechanism 39 is moved with the feed mechanism 31 at the same time. With a separator/feeder equipped with such a moving mechanism 39, it is possible to detect undulations of the pile 27 of sheets of paper-like medium at the contact point of the vibrator 22 by comparing the position of the vibrator 22 and the position of the uppermost surface of the sheets 29 of paper-like medium in terms of either relative value or absolute value. Then, it is possible to appropriately control the pressure FV.

Figure 16A:
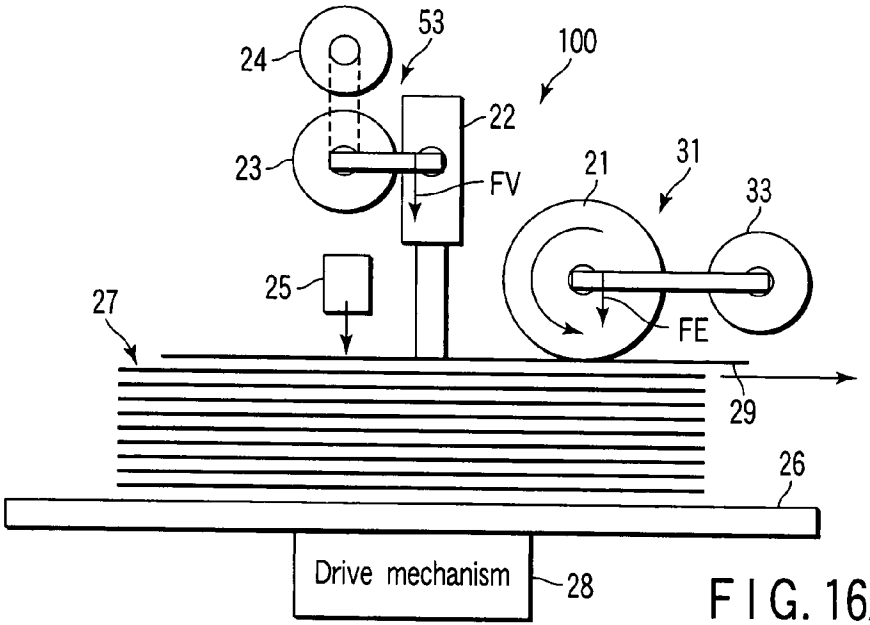
FIGS. 16A to 16C are schematic illustrations of a second embodiment of separator/feeder for sheets of paper-like medium.
Figure 16B:
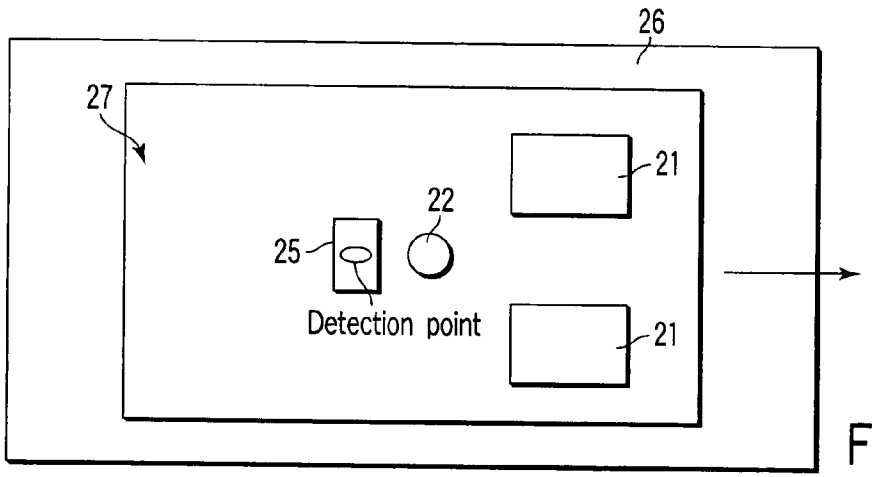
Figure 16C:
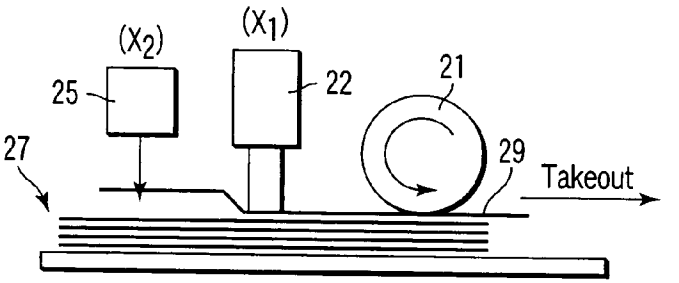

FIGS. 16A and 16B are schematic illustrations of the second embodiment of separator/feeder 100 of sheets of paper-like medium according to the invention. In the separator/feeder 100 of sheets of paper-like medium illustrated in FIGS. 16A and 16B, the sensor 25 is arranged at the upstream side of the contact point of vibrator 22 where the vibrator 22 touches the uppermost sheet 29 of paper-like medium of a pile on a backup table as viewed in the direction of taking out sheets 29 of paper-like medium. Thus, the sensor 25 detects the position of the uppermost sheet 29 of paper-like medium in the X-direction at an upstream position relative to the contact point of the vibrator 22. With this arrangement, it is possible to substantially control the pressure of the vibrator 22 according to the state of the surface of the uppermost sheet 29 of paper-like medium passing the contact point of the vibrator 22 during the operation of taking out the sheet 29 of paper-like medium. More specifically, the recess and the bulge, if the sheet 29 of paper-like medium are detected in advance immediately before the recess or the bulge comes into contact with the vibrator 22 so that it is possible to control the pressure of the vibrator 22 according to the extent (state) of recess or bulge of the sheet 29 of paper-like medium. For example, if the sheet 29 of paper-like medium is recessed at the position where it contacts the vibrator 22 and the bulge of the sheet 29 of paper-like medium that is coming to contact the vibrator 22 can be caught by the latter as shown in FIG. 16C, the pressure FV of the vibrator 22 is reduced so that the sheet 29 of paper-like medium may smoothly pass under the vibrator 22. It is desirable that the real time pressure control technique of controlling the pressure of a vibrator 22 as described above by referring to FIG. 14 is applied to the separator/feeder illustrated in FIGS. 16A and 16B.

As described above, the separator/feeder 100 can be used with a machine that handles various sheets of paper-like mediums that are different in terms of thickness, shape and size.

According to an experiment conducted by the inventors of the present invention, it was found that any change in the thickness of sheets 29 of paper-like medium does not substantially adversely affect the effect of reducing the frictional force of the vibrator 22. This is because sheets of paper-like medium that are thicker than about 1.0 mm can hardly been taken out in duplicate. The inventors of the present invention conducted an experiment on sheets 29 of paper-like medium having a thickness between 0.1 mm and 1.0 mm. As a result of the experiment, it was found that the effect of loosening sheets 29 of paper-like medium is reduced slightly as the thickness of sheets 29 of paper-like medium increased but still conspicuously observed for thick sheets 29 of paper-like medium. On the other hand, no adverse effect such as a torn sheet 29 of paper-like medium was observed when the vibrator 22 touched a sheet 29 that was thin to a certain degree and the effect of loosening sheets 29 of paper-like medium was also conspicuously observed. In short, if the sheets 29 of paper-like medium to be treated show changes in the thickness, the above-described separator/feeder 100 of the embodiment operates effectively with respect to sheets 29 of paper-like medium having various thicknesses.

Now, the influence of a deformed sheet 29 of paper-like medium such as a warped sheet 29 on the operation of taking out the sheet 29 of paper-like medium and a control method that can accommodate the influence will be described below. When sheets 29 of paper-like medium show various shapes, it is possible to smoothly take out sheets 29 of paper-like medium by means of the technique of detecting the surface profile of the uppermost sheet 29 of paper-like medium in advance as described above in terms of the separator/feeder illustrated in FIGS. 16A and 16B.

Figure 17A:
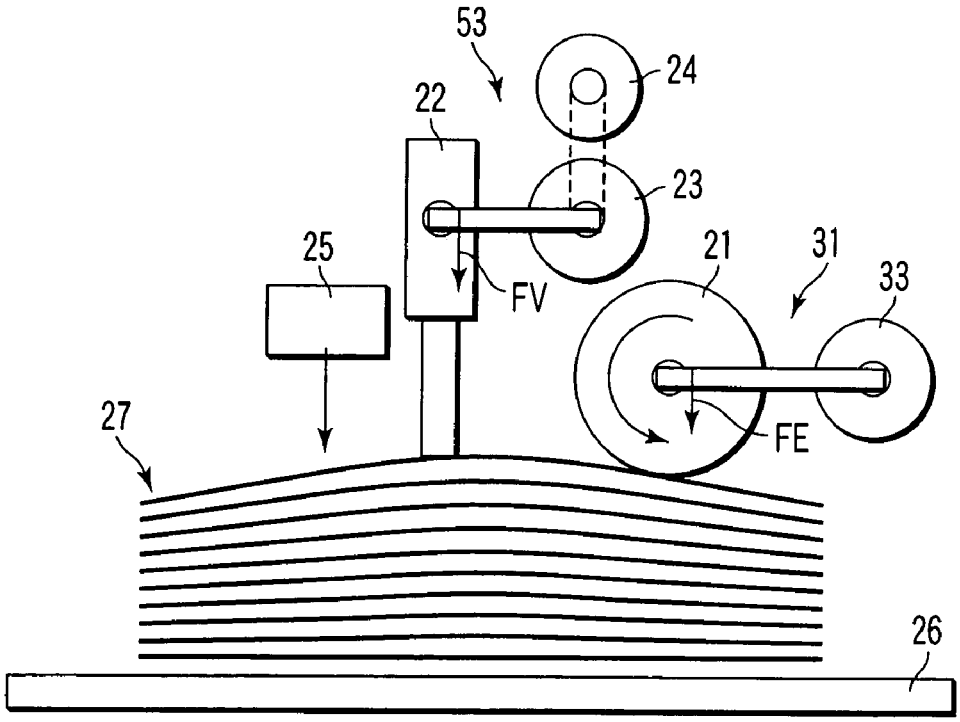
FIGS. 17A and 17B are schematic illustrations of the operation of the separator/feeder for sheets of paper-like medium of FIG. 16A when the entire pile of sheets of paper-like medium is warped upward.
Figure 17B:
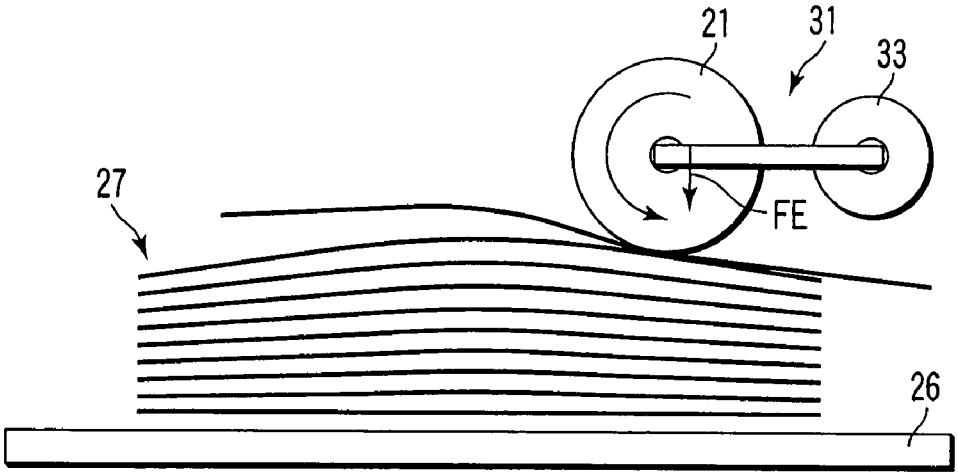

When the entire pile 27 of sheets of paper-like medium is bulged as shown in FIG. 17A, the uppermost sheet 29 of paper-like medium will be lifted during an operation of being taken out as shown in FIG. 17B so that the vibrator 22 may no longer be able to follow the surface profile of the sheet 29 of paper-like medium. However, with the separator/feeder illustrated in FIGS. 16A and 16B, if the uppermost sheet 29 of paper-like medium is lifted and the vibrator 22 is pushed up by the lifted sheet 29 of paper-like medium, no problem arises for detecting undulations of the sheet 29 of paper-like medium and the pressure of the vibrator 22 is raised immediately after the rear edge of the sheet 29 of paper-like medium passes the detection point of the sensor 25 because the relative position of the vibrator 22 is high so that the lift of the next sheet 29 of paper-like medium is suppressed and the next sheet 29 can be moved smoothly. Thus, the separator/feeder illustrated in FIGS. 16A and 16B can reliably take out the uppermost sheet 29 of paper-like medium if the entire pile 27 of sheets of paper-like medium is bulged.

Figure 18A:
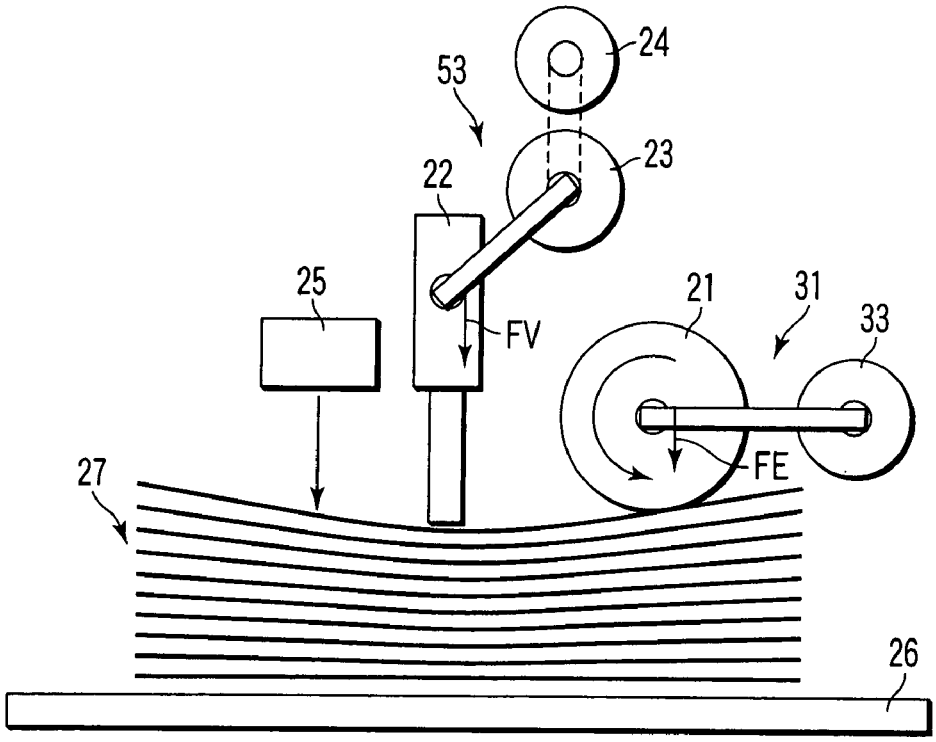
FIGS. 18A and 18B are schematic illustrations of the operation of the separator/feeder for sheets of paper-like medium of FIG. 16A when the entire pile of sheets of paper-like medium is warped downward.
Figure 18B:
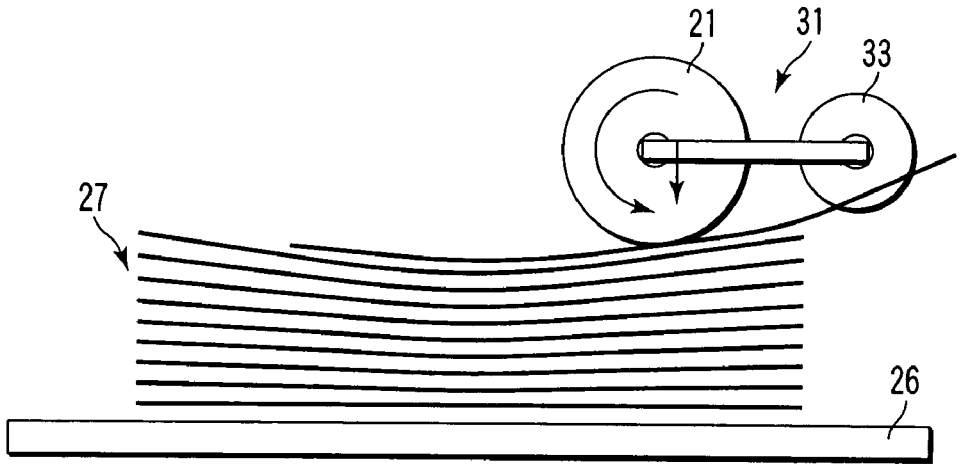
Figure 19:
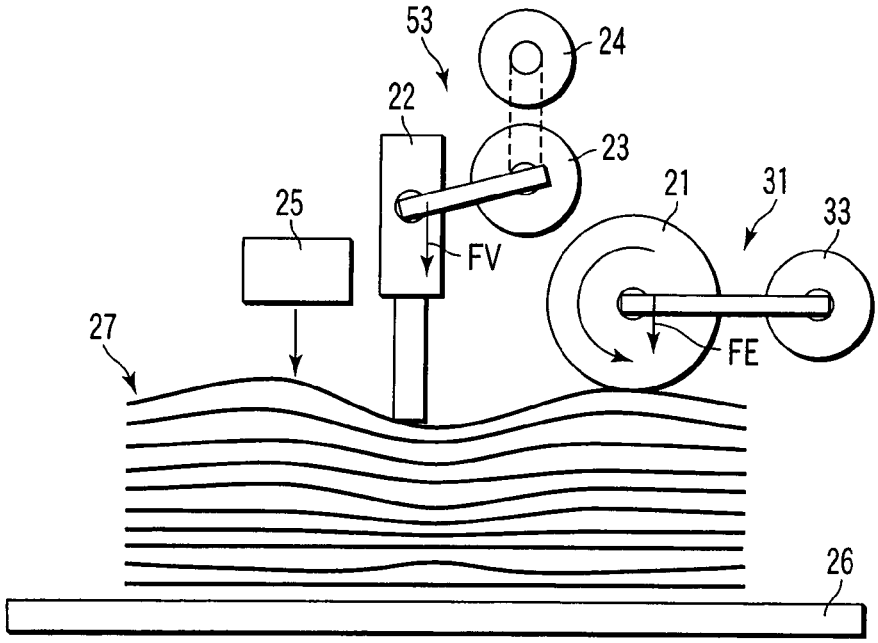
FIG. 19 is a schematic illustration of the operation of the separator/feeder for sheets of paper-like medium of FIG. 16A when the entire pile of sheets of paper-like medium is undulated.

When the entire pile 27 of sheets of paper-like medium is recessed as shown in FIGS. 18A and 18B, there is a risk that the front end of the vibrator 22 damages the uppermost sheet 29 of paper-like medium. In this case again, with the separator/feeder illustrated in FIGS. 16A and 16B, the recess and the bulge, if the sheet 29 of paper-like medium are detected in advance immediately before the recess or the bulge comes into contact with the front end of the vibrator 22 so that it is possible to reduce the pressure of the vibrator 22 and prevent the front end of the vibrator 22 from damaging the sheet 29 of paper-like medium. If the pile 27 of sheets of paper-like medium shows undulations as shown in FIG. 19, it is possible to take out the uppermost sheet 29 of paper-like medium without any problem by controlling the pressure FV of the vibrator 22 depending on the undulations of the sheet 29 of paper-like medium as detected at the position immediately before contacting the vibrator 22.

Actual machines are devised to suppress changes in the profile of the pile 27 of sheets of paper-like medium. For example, an idle roller is pressed against the surface of the pile 27 of sheets of paper-like medium to suppress the warp, if the uppermost sheet 29 of paper-like medium. Therefore, it may be safe to assume that the deformation of the sheet of paper-like medium, if any, practically does not influence the operation of the vibration/loosening mechanism (vibration mechanism). As described above, the separator/feeder illustrated in FIGS. 16A and 16B can reliably loosen sheets 29 of paper-like medium, if the profile of the pile 27 of paper-like medium is deformed.

Now, the influence of the size of sheets 29 of paper-like medium on the loosening effect of vibrations will be discussed below. It may be safe to assume that the loosening effect of vibrations appears as the entire uppermost sheet 29 of paper-like medium vibrates. Therefore, when the sheets 29 of paper-like medium are very large, vibrations may not propagate over the entire uppermost sheet 29 and hence the loosening effect may not be satisfactory. When, the power of vibrations is weak, a satisfactory loosening effect can be achieved by arranging a plurality of vibrators 22 and a plurality of pressure mechanisms 53 for pressing the vibrators 22.

If, on the other hand, the size of sheets 29 of paper-like medium is extremely small and the sheets 29 cannot brought into contact with the vibrator 22, it is not possible to loosen such small sheets 29 of paper-like medium by vibrations. However, the present invention can be applied to sheets 29 of paper-like medium having the size of ordinary name cards or that of post cards, which is about 92 mm×52 mm. Thus, the above-described embodiments of separator/feeder according to the present invention can be applied to sheets of paper-like medium in general.

Figure 20:
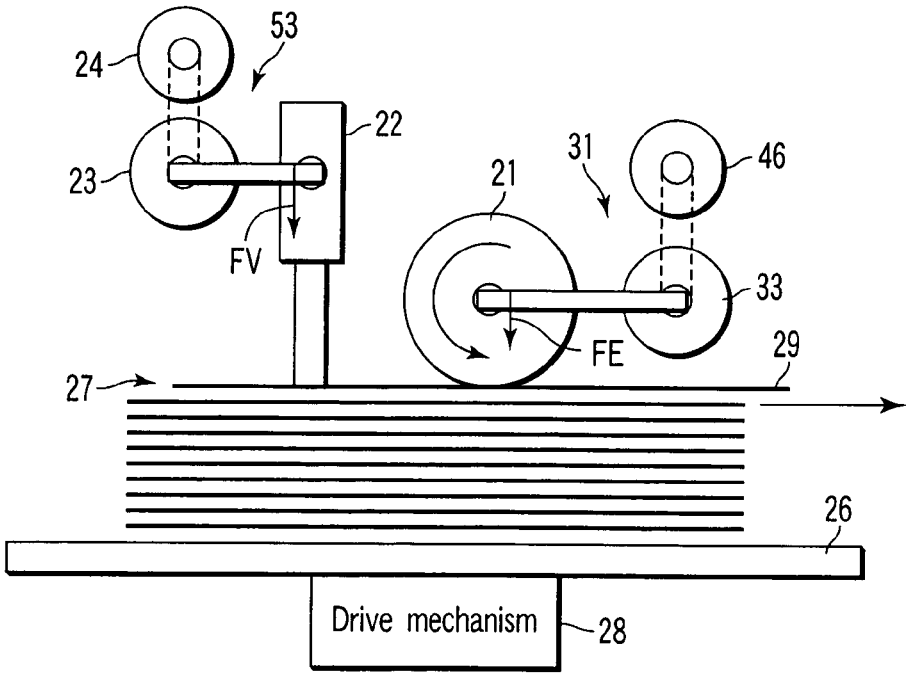
FIG. 20 is a schematic illustration of a third embodiment of separator/feeder for sheets of paper-like medium.

FIG. 20 is a schematic illustration of the third embodiment of separator/feeder 100 of sheets of paper-like medium according to the invention. Unlike the separator/feeder of FIG. 3, the separator/feeder 100 illustrated in FIG. 20 is equipped with a displacement sensor 46 for detecting the position of the uppermost surface of a pile 27 of sheets of paper-like medium in place of the position sensor 25 of the separator/feeder of FIG. 3. The potentiometer that operates as the sensor 46 is connected to the torque motor 23 for driving the takeout/feed mechanism 31 and indirectly observes the position where the takeout/feed mechanism 31 touches the uppermost sheet 29 of paper-like medium by detecting the rotational position of the torque motor 23.

Figure 21:
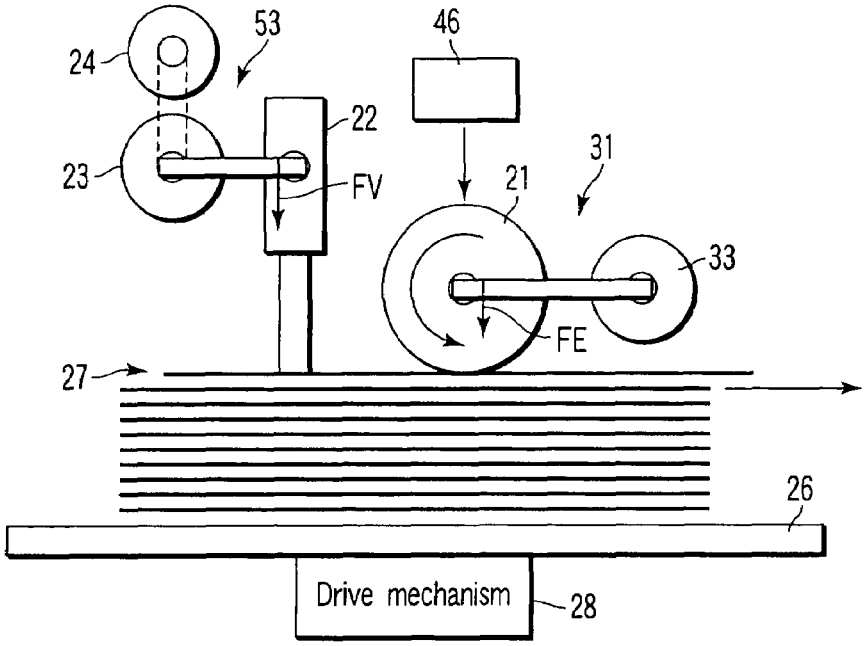
FIG. 21 is a schematic illustration of a separator/feeder obtained by modifying the separator/feeder of FIG. 20.

Alternatively, an optical position sensor may be used as the sensor 46 to directly observe the position of the takeout/feed mechanism 31 as shown in FIG. 21. In FIG. 21, the sensor 46 observes the position of the pile 27 of sheets of paper-like medium like the sensor 25 of FIG. 3. In the case of the separator/feeder illustrated in FIG. 21, the pressure FV of the vibrator 22 is controlled according to the output of the sensor.

Figure 22:
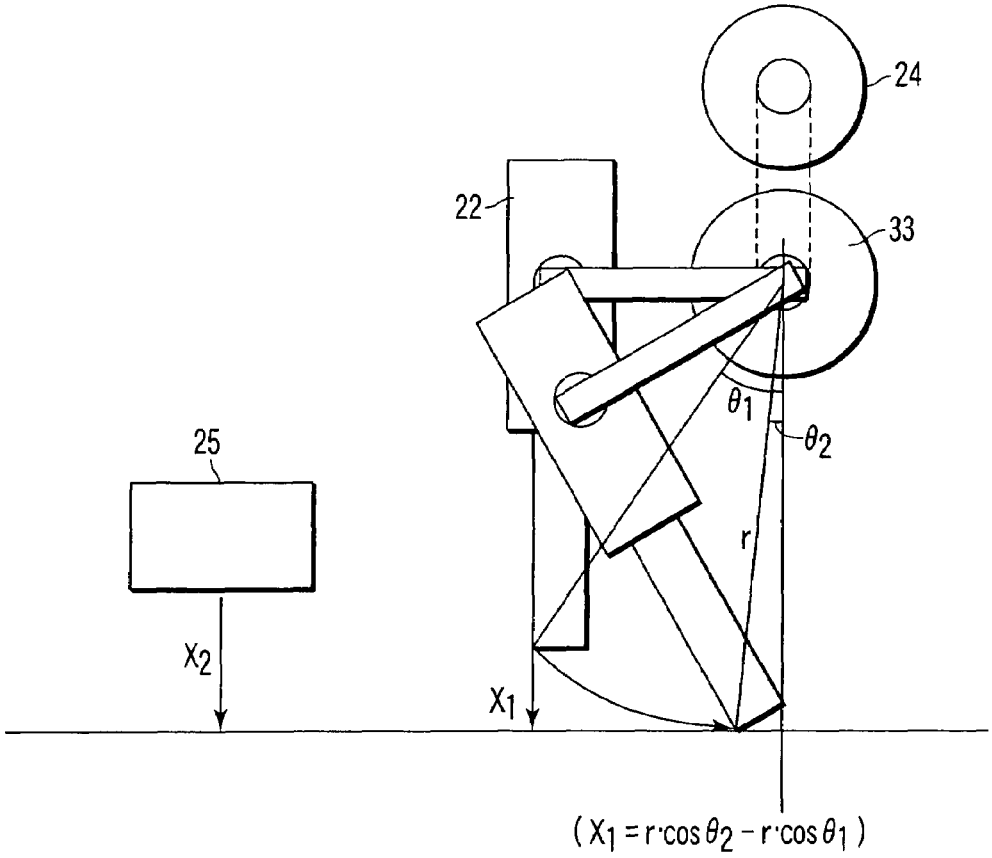
FIG. 22 is a schematic illustration of the operation of reducing the moving distance of the sheets of paper-like medium in the vertical direction of the separator/feeder for sheets of paper-like medium of FIG. 20.

When a mechanism with which the vibrator 22 is pressed against sheets 29 of paper-like medium along the rotational trajectory thereof typically by a torque motor as illustrated in FIGS. 3, 20 and so on, it is necessary to be careful about the observation coordinates of the sensors 24, 44. The position of the vibrator 22 needs to be observed as the distance to the surface of the pile 27 of sheets of paper-like medium in the vertical direction. The distance of movement of the vibrator 22 on the rotational trajectory is reduced to the distance of movement in the direction perpendicular to the sheets 29 of paper-like medium as shown in FIG. 22. In the coordinate system shown in FIG. 22, the center of rotation of the torque motor 23 is selected as the origin of the coordinate system and the axis X running in the direction perpendicular to the uppermost surface of the pile 27 of sheets of paper-like medium is defined as reference axis. In the rotational coordinate system, the front end of the vibrator 22 is arranged with the initial angle of rotation θ1 and separated from the pile 27 of sheets of paper-like medium by distance $X_1$. In this state, assume that the front end of the vibrator 22 is rotated with a radius of rotation of r by an angle of rotation of θ2 as a result of that the uppermost sheet 29 of paper-like medium is removed under the above conditions. Then, the distance $X_1$ is determined by the formula shown below.

$$X_1 = r \cdot \cos\theta 2 - r \cdot \cos\theta 1$$

The distance $X_1$ corresponds to the distance by which the front end of the vibrator 22 is moved linearly toward the sheets 29 of paper-like medium as a result of that the uppermost sheet 29 of the paper-like medium is removed. Thus, the pressure FV of the vibrator 22 is controlled by the sensor output $X_1$ that corresponds to the distance $X_1$ to give appropriate vibrations to and exert a loosening effect on the pile 27 of sheets of paper-like medium. Any computational technique may be used for reducing the distance into the sensor output $X_1$ so long as it is based on the above-described formula. Additionally, the difference between the quantity of movement on the rotational coordinate system and the quantity of movement after the reduction can be within the range of error depending on the machine. In such a case, the quantity of movement on the rotational coordinate system, or $\{r\cdot(\theta 2-\theta 1)\}$ may be directly used to determine the right position.

It is desirable that the largest permissible displacement of the position of the vibrator 22 is defined for each machine by referring to the thickness of the sheets 29 of paper-like medium to be handled in order to prevent any abnormal motion of the vibrator 22 from taking place. Additionally, it is desirable to stop the vibrations of the vibrator 22 when a positional change of the vibrator 22 that exceeds the largest permissible displacement is detected by the sensor 24 or 44. For example, sheets 29 of paper-like medium that are handled by mail sorters has a thickness of 10 mm at most so that it may be so arranged that the vibrations of the vibrator 22 are stopped when the vibrator 22 is displaced by more than ±11 mm.

Displeasing resonating sounds arise when the vibrator 22 hits a structural part of the separator/feeder such as the backup table 26 that is a holding section, while vibrating. For the purpose of avoiding generation of noises that takes place when the vibrator 22 contacts some other part of the separator/feeder, it is desirable that the separator/feeder designed in such a way that the vibrating part of the vibrator 22 is free from any structural part made of metal, plastic or the like within the movable range of the vibrating part.

The above-described takeout/feed mechanism 31 is not limited to the takeout roller 21 of the friction/takeout type and may alternatively be a belt of the friction/takeout type, a roller or a belt mechanism of the vacuum suction type.

The mechanism for providing the contact pressure FV may be a torque motor, a pneumatic cylinder, a hydraulic cylinder or a spring structure. While a direct-acting mechanism is desirable for supporting the takeout/feed mechanism 31 and the vibrator 22, a rotary mechanism may alternatively be used for supporting them.

The vibration frequency of the vibrator 22 needs to be higher than 18 kHz that is in the inaudible frequency range. The amplitude of vibrations of the front end of the vibrator 22 is required to be not less than 1 μm in order to reliably realize the effect of loosening a bundle of sheets of paper-like medium.

The holding section for holding a pile 27 of sheets of paper-like medium is not limited to the above-described backup table 26 and may be replaced by any other holding structure such as a structure for supporting the rear side of a pile 27 of sheets of paper-like medium by means of a plate-like member, a roller or a belt.

Any of various sensors that can detect the quantity of displacement of the pressure adjustment mechanism 53 and that of displacement of the vibrator 22 may be used for the sensors 24, 44. Sensors that can be used for the purpose of the present invention include optical position sensors of the LED type and the laser type, sensors like potentiometers for detecting the rotational position of a torque motor and solenoid type sensors.

Any of various sensors that can detect the top position of the pile 27 of sheets of paper-like medium can be used for the sensor 25. Sensors that can be used for the sensor 25 include optical position sensors of the LED type and the laser type and movable levers that touch the top surface of sheets of paper-like medium with a light pressure not greater than 100 [gf]. Alternatively, as described above, the sensor 46 may be arranged at the takeout/feed mechanism 31 to detect the top surface position of the pile 27 of sheets of paper-like medium from the position where the takeout/feed mechanism 31 contacts the pile 27 of sheets of paper-like medium. A sensor of the type same as the sensors 24, 44 may be used for the sensor 46.

Preferably, the vibrator 22 and the sensor 25 are arranged with such a positional relationship that the distance between the contact point of the vibrator 22 with the pile 27 of sheets of paper-like medium and the detection point of the sensor 25 is about 5 to 20 mm and no undulations appear on the pile 27 of sheets of paper-like medium between them.

While a pile 27 of sheets of paper-like medium is placed on the backup table 26 in each of the above-described embodiments, it may alternatively be so arranged that the backup table 26 is standing and the pile 27 of sheets of paper-like medium is held by the backup table 26 in such a way that it is juxtaposed with a lateral surface of the backup table 26 so that a sheet 29 of paper-like medium of the pile 27 is taken out upwardly or downwardly from the front of the lateral side of the pile 27 of sheets of paper-like medium that is most remote from the backup table 26. If the pile 27 of sheets of paper-like medium is not placed on the backup table 26 but the pile 27 of sheets of paper-like medium is held by the backup table 26 differently, the front of the lateral side of the pile 27 of sheets of paper-like medium where the sheet 29 of paper-like medium to be taken out is located is the top surface of the pile 27 of sheets of paper-like medium. Thus, the top surface of a pile 27 of sheets of paper-like medium may be the front of a lateral side of the juxtaposed pile 27 of sheets of paper-like medium for the purpose of the present invention.

As described above, with a separator/feeder for sheets of paper-like medium according to an aspect of the present invention, it is possible to reliably provide a loosening effect by means of vibrations regardless of the type of sheets of paper-like medium and reliably prevent sheets of paper-like medium from taken out in duplicate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A separator and feeder comprising:

a holding mechanism that holds a pile of sheets of paper-like medium;

a vibrator which is held in contact with a first region of the top surface of the pile under a first contact pressure to apply high frequency vibrations to sheets of paper-like medium;

a takeout mechanism that takes out the sheets of paper-like medium one by one from top surface of the pile in a state of being held in contact with the top surface of the pile to apply a second contact pressure to the top surface of the pile;

a first sensor which detects a first position of the vibrator held in contact with the pile and output a first detection signal;

a second sensor which detects a second position of the top surface of the pile in a second region of the pile and outputs a second detection signal; and a control section that determins the first and second contact pressures according to the first and second detection signals and maintain the first and second contact pressures respectively in first and second predetermined ranges.

2. The separator and feeder according to claim 1, wherein the vibrator has a front end section to be brought into contact with and pressed against the pile in a spot area.

3. The separator and feeder according to claim 1, wherein the second region is located upstream relative to the first region, the direction of taking out sheets of paper-like medium being the downstream direction.

4. The separator and feeder according to claim 1, wherein the first region and the second region are arranged in proximity relative to each other with a distance selected from a range between 5 and 20 mm.

5. The separator and feeder according to claim 1, wherein the takeout mechanism is selected from mechanisms including a roller or belt for taking out sheets of paper-like medium by frictional force and a mechanism for taking out sheets of paper-like medium by means of force of vacuum/adsorption.

6. The separator and feeder according to claim 1, wherein the takeout mechanism includes a takeout section to be brought into contact with to take out the sheets of paper-like medium and a press mechanism for pressing the takeout section against the pile.

7. The separator and feeder according to claim 1, wherein the vibrator includes a vibrating section and a press mechanism for pressing the vibrating section against the sheets of paper-like medium.

8. The separator and feeder according to claim 1, wherein the vibrator includes a vibrating section that vibrates with a frequency not less than 18 kHz and an amplitude not less than 1 μm.

9. The separator and feeder according to claim 8, wherein the vibrator includes a vibration horn that is vibrated by the vibrating section and brought into contact with the pile.

10. The separator and feeder according to claim 1, wherein the holding mechanism includes a backup plate for bearing the pile placed thereon, a backup roller and a backup belt.

11. The separator and feeder according to claim 1, wherein the takeout mechanism includes a contact section contacting the pile in a third region; and the separator/feeder further comprises a third sensor configured to detect a third position of the contact section.

12. A separator and feeder comprising:

a holding mechanism configured to hold a pile of sheets of paper medium;

a vibrator which is held in contact with a first region of the top surface of the pile under a first contact pressure to apply high frequency vibrations to the sheets of paper-like medium;

a takeout mechanism that takes out the sheets of paper-like medium one by one from top surface of the pile in a state of being held in contact with the top surface of the pile to apply a second contact pressure to the top surface of the pile;

a first sensor which detects a first position of the vibrator held in contact with the pile and outputs a first detection signal;

a second sensor which detects a second position of the top surface of the pile in a second region and outputs a second detection signal; and a control section that determines the first and second contact pressures according to the outcome of a comparison of a first displacement of the first position and a second displacement of the second position before and after taking out the sheet of paper-like medium from the top surface of the pile according to the first and second detection signals and maintain the first and second contact pressures respectively in first and second predetermined ranges.

13. The separator and feeder according to claim 12, wherein the vibrator has a front end section to be brought into contact with and pressed against the pile in a spot-like area.

14. The separator and feeder according to claim 12, wherein the control section compares the first displacement and the second displacement to determine undulations of the uppermost surface of the pile, if the first region is recessed relative to the second region, the control section decreases the first contact pressure within the first predetermined range, and if the first region is bulged relative to the second region, the control section increases the first contact pressure within the first predetermined range.

15. The separator and feeder according to claim 12, wherein the control section determines the first contact pressure according to a function that uses the quantity of undulation that corresponds to the difference between the first displacement and the second displacement.

16. The separator and feeder according to claim 12, wherein the second region is located upstream relative to the first region, the direction of taking out sheets of paper-like medium being the downstream direction.

17. The separator and feeder according to claim 12, wherein the first region and the second region are arranged in proximity relative to each other with a distance selected from a range between 5 and 20 mm.

18. The separator and feeder according to claim 12, wherein the vibrator includes a vibrating section that vibrates with a frequency not less than 18 kHz and an amplitude not less than 1 μm.

19. The separator and feeder according to claim 12, wherein the vibrator includes a vibration horn that is vibrated by the vibrating section and brought into contact with the pile.

20. A separator and feeder comprising:

a holding mechanism that holds a pile of sheets of paper medium;

a vibrator which is held in contact with a first region of the top surface of the pile under a first contact pressure to apply high frequency vibrations to sheets of paper-like medium;

a takeout mechanism that takes out the sheets of paper-like medium one by one from top surface of the pile in a state of being held in contact with the top surface of the pile to apply a second contact pressure to the top surface of the pile;

a first sensor which detects a first position of the vibrator held in contact with the pile and outputs a first detection signal;

a second sensor which detects a second position of the top surface of the pile in a second region of the pile and outputs a second detection signal; and a control section that compares the first and second detection signals to estimate the undulations of the first region of the pile, determine the first and second contact pressures according to the undulations and maintaining the first and second contact pressures respectively in first and second predetermined ranges.

21. The separator and feeder according to claim 20, wherein the control section estimates the undulation of the first region according to the difference between the first detection signal and the second detection signal.

22. The separator and feeder according to claim 21, wherein the control section increases the first contact pressure from a reference value if the first detection signal is greater than the second detection signal and the control section decreases the first contact pressure from the reference value if the first detection signal is smaller than the second detection signal, wherein the direction moving away from the pile is defined as the positive direction.

23. The separator and feeder according to claim 22, wherein the control section determines the first contact pressure according to a function that uses the quantity of undulation that corresponds to the difference between the first detection signal and the second detection signal as variable.

24. The separator and feeder according to claim 23, wherein the vibrator has a front end section to be brought into contact with and pressed against the pile in a spot-like area.

25. The separator and feeder according to claim 20, wherein the second region is located upstream relative to the first region, the direction of taking out sheets of paper medium being the downstream direction.

26. The separator and feeder according to claim 20, wherein the first region and the second region are arranged in proximity relative to each other with a distance selected from a range between 5 and 20 mm.

27. The separator and feeder according to claim 20, wherein the vibrator includes a vibrating section that vibrates with a frequency not less than 18 kHz and an amplitude not less than 1 μm.

28. The separator and feeder according to claim 20, wherein the vibrator includes a vibration horn that is vibrated by the vibrating section and brought into contact with the pile.

* * * * *